US009890527B2

(12) United States Patent
Shinohara et al.

(10) Patent No.: US 9,890,527 B2
(45) Date of Patent: Feb. 13, 2018

(54) OPERATING DEVICE, FLUSH WATER TANK DEVICE, AND FLUSH TOILET

(71) Applicant: TOTO LTD., Fukuoka (JP)

(72) Inventors: Koki Shinohara, Kitakyushu (JP); Hideki Tanimoto, Kitakyushu (JP); Kenji Hatama, Kitakyushu (JP); Makoto Abe, Kitakyushu (JP)

(73) Assignee: TOTO LTD., Fukuoka (JP)

( * ) Notice: Subject to any disclaimer, the term of this patent is extended or adjusted under 35 U.S.C. 154(b) by 0 days.

(21) Appl. No.: 15/455,636

(22) Filed: Mar. 10, 2017

(65) Prior Publication Data

US 2017/0260726 A1 Sep. 14, 2017

(30) Foreign Application Priority Data

Mar. 14, 2016 (JP) ..... 2016-050111

(51) Int. Cl.
*E03D 5/09* (2006.01)
*E03D 1/30* (2006.01)

(52) U.S. Cl.
CPC ..... *E03D 5/09* (2013.01); *E03D 1/308* (2013.01)

(58) Field of Classification Search
CPC ..... E03D 5/09; E03D 5/094
USPC ..... 4/405, 411–414
See application file for complete search history.

(56) References Cited

U.S. PATENT DOCUMENTS 1,605,028 A * 11/1926 Hinkle ..... E03D 5/092 4/414
2,412,738 A * 12/1946 Martin ..... E03D 5/094 4/412
8,201,283 B2 * 6/2012 Ciski ..... E03D 5/094 4/325
8,393,018 B2 * 3/2013 Huang ..... E03D 5/092 4/324
9,340,962 B2 * 5/2016 Tanimoto ..... E03D 5/094
9,447,569 B2 * 9/2016 Shinohara ..... E03D 3/12
9,605,418 B2 * 3/2017 Lambert ..... E03D 5/02
(Continued)

FOREIGN PATENT DOCUMENTS

DE 380567 C * 9/1923 ..... E03D 5/094
JP H03-005184 U 1/1991
(Continued)

*Primary Examiner* — Erin Deery
(74) *Attorney, Agent, or Firm* — Studebaker & Brackett PC

(57) ABSTRACT

An operating device includes a rotary shaft, an operating handle, an operating wire, and a drive unit; wherein this drive unit includes: a rotary member, a rotary windup member, a locking device for mutually locking the rotary member and the rotary windup member until the rotary windup member rotates in the forward rotational direction from a first operating position and reaches a second operating position, a lock release device for releasing the lock between the rotary member and the rotary windup member so the rotary windup member rotates in the reverse rotational direction and moves to the first operating position regardless of any operation of the operating handle when the rotary member and the rotary windup member reach the second operating position, and a biasing device for restoring the rotary member to an initial position at which a toilet flush operation can be started from the operating position.

5 Claims, 13 Drawing Sheets

(56) References Cited

U.S. PATENT DOCUMENTS

| | | | | |
|---|---|---|---|---|
| 9,695,581 | B2 * | 7/2017 | Shinohara | E03D 1/34 |
| 2017/0051485 | A1 * | 2/2017 | Shinohara | E03D 5/094 |

FOREIGN PATENT DOCUMENTS

| | | | |
|---|---|---|---|
| JP | 2014-190131 | A | 10/2014 |
| JP | 2014-194266 | A | 10/2014 |

* cited by examiner

OPERATING DEVICE, FLUSH WATER TANK DEVICE, AND FLUSH TOILET

TECHNICAL FIELD

The present invention relates to an operating device; a flush water tank device; and a flush toilet, and more particularly relates to an operating device for a flush water tank device including a flush water tank storing flush water and a discharge valve disposed in the flush water tank; a flush water tank device and a flush toilet.

BACKGROUND

For some time, known flush water tank device operating devices for starting the supply of flush water to a toilet by operating to start the opening of a discharge valve on a flush water tank device for supplying flush water to a toilet have included those in which, as noted for example in Patent Document 1 (Japanese Patent Unexamined Publication No. 2014-190131), in a discharge valve device for opening and closing a discharge port on a flush water tank by up and down movement ("direct-drive discharge valve device"), the amount of up and down movement of the discharge valve body is controlled by controlling the amount of movement of an operating wire, for example the amount by which an operating wire connected to a discharge valve body is pulled up (or the amount by which the operating wire is wound).

Such a conventional operating device for a flush water tank device noted in Patent Document 1 comprises an operating portion such as an operating handle or the like which can be rotationally operated by a user, and a pulley for winding up an operating wire in tandem with the rotational movement of this operating portion. Also, the operating portion and pulley are mutually constantly linked, irrespective of operating state, and the amount of flush water supplied from the flush water tank device to the toilet is determined by the time from the start of the discharge valve opening operation by rotating the operating portion and pulley at an initial position so that the operating wire is wound in, until the discharge valve body drops with the descent of the water level inside the flush water tank to close the valve, i.e., the operating time from the start to end of the operation by the operating portion (operating portion operating time), or by the amount of time the discharge valve body is open (the discharge valve body valve opening time).

Hence, for example, the longer the time during which the operating handle and pulley are maintained in a rotated state, the operating wire is maintained in a wound state, and the discharge valve body is maintained in a pulled up state, the longer the operating portion operating time or discharge valve body opening time will extend, and the greater the amount of flush water supplied from the flush water tank device to the toilet.

In recent years, on the other hand, due to water conservation in toilet flushing, the amount of flush water usable for a toilet flush has been reduced, for example, to a regulation amount of 3.8 L, but depending on the length of the operating portion operating time, the discharge valve opening time may be longer than the valve opening time over which toilet flushing can be sustained within the regulated flush water amount, making it difficult to flush the toilet while controlling the flush water amount to within the regulated amount. Also, in the above-described conventional flush water tank device operating device, wherein the operating portion and the pulley are mutually constantly linked regardless of operating state, or the operating portion is operated manually, there are limits in the degree to which the operating portion operating time can be shortened, leading to a problem of poor operability and usability.

In addition, in an operating device for a flush water tank device, a rotary operation to raise an operating portion or a rotary operation to push down an operating portion are conventionally performed at the start of each toilet flush to wind the operating wire onto a pulley rotating in a predetermined valve opening direction and open a discharge valve body, and thereafter the operating wire is unwound by rotating in a predetermined valve closing direction, thereby closing the discharge valve body.

In particular, the operating portion after the discharge valve body has been fully opened is arranged to return by gravity alone to an initial position at which the next discharge valve opening operation can be started, but if the operating portion returns slowly at a relatively low speed, the rubbing resistance of the rotary shaft linked to the operating portion or the pulley and resistance of other related functional parts may be very influential, such that the operating portion will not necessarily be restored correctly to its initial position. This then becomes an obstacle to maintaining the operating performance of an operating device capable of accurately operating in each repeated toilet flushing.

SUMMARY

The present invention was therefore undertaken to solve the above-described problems with the conventional art, and has the object of providing an operating device for a flush water tank device capable of quickly and accurately restoring an operating portion to an initial position each time a series of toilet flush operations is completed.

In order to accomplish the object above, the present invention is an operating device for a flush water tank device including a flush water tank storing flush water to be supplied to a toilet and a discharge valve disposed in the flush water tank, the operating device comprising: a rotary shaft extending from an inside to an outside of the flush water tank; an operating portion configured to rotate the rotary shaft, the operating portion being attached to an outside end of the rotary shaft positioned on the outside of the flush water tank; a linking member including one end and other end, the one end being linked to the discharge valve; and a drive unit attached to an inside end of the rotary shaft positioned on the inside of the flush water tank so as to be linked to the other end of the linking member, the drive unit being configured to drive the discharge valve by a rotary operation of the operating portion so as to move the linking member from a first operating position to a second operating position, the first operating position corresponding to a closed position of the discharge valve, and the second operating position corresponding to a fully open position of the discharge valve; wherein the drive unit includes: a rotary portion fixed to the rotary shaft, the rotary portion being configured to rotate with the rotary shaft; a rotary windup member to which the other end of the linking member is linked, the rotary windup member being configured to engage the rotary portion so as to rotate together with the rotary portion from the first operating position to the second operating position when the rotary shaft and the rotary portion are rotating in a direction of opening the discharge valve in order to wind up a predetermined amount of the linking member; a locking device configured to mutually lock the rotary portion and the rotary windup member until the rotary windup member rotates from the first operating position and reaches the second operating position; a lock release device configured to release a lock between the rotary portion and the rotary windup member so as to turn the rotary windup member from the second operating position to the first operating position regardless of operating the operating portion when the rotary portion and the rotary windup member respectively rotate from the first operating position and reaches the second operating position; and an initial position restoration biasing device configured to bias the rotary portion so as to restore the rotary portion to the first operating position when the rotary portion reaches the second operating position.

According to the invention thus constituted, at the start of supply of flush water to the toilet by an operation opening the discharge valve on the flush water tank device supplying flush water to the toilet, when the operating portion for operating a toilet flush is rotated from a first operating position corresponding to the discharge valve closed position to a second operating position corresponding to the discharge valve fully open position, the rotary shaft rotates along with this operating portion in the valve closing direction, closing the discharge valve, and along with this rotary shaft, the drive unit rotary portion rotates as one piece from the first operating position to the second operating position.

At this point, because the drive unit rotary windup member is locked by the locking device to the rotary portion, the rotary windup member also rotates together with the rotary portion from a first operating position in a predetermined valve opening direction until reaching a second operating position. Therefore winding by the rotary windup member of the linking member linking the discharge valve and the drive unit rotary windup member causes the discharge valve to move in the valve opening direction from a valve closed position, so that flush water is supplied from the flush water tank to the toilet.

When the rotary portion and the rotary windup member respectively rotate from the first operating position in their respective predetermined valve opening directions and reach the second operating position, and the linking member linking the discharge valve and the drive unit rotary windup member is wound up by a predetermined amount by the rotary windup member, the discharge valve moves a distance equal to a predetermined amount of this wound linking member, from the valve closed position to the fully open position. Simultaneously, a lock release device releases the lock between the rotary portion and the rotary windup member, and the rotary windup member rotates in a predetermined valve closing direction opposite the predetermined valve opening direction to move to the first operating position, regardless of any operation by the operating portion.

I.e., when the discharge valve opening operation is started and the discharge valve moves temporarily to a fully open position, at least the rotary windup member and the linking member promptly move to the first operating position so the discharge valve can close the discharge valve, thereby enabling a toilet flush in which the amount of flush water supplied from the flush water tank to the toilet in each toilet flush is controlled to a specified amount.

Also, the time from the start of the discharge valve opening operation until valve closing (the discharge valve opening time) can be shortened by the lock release device and the specified amount of flush water required for toilet flushing can also be set relatively low, therefore toilet flush water can be conserved.

In addition, when the rotary portion reaches the second operating position together with rotary windup member, it can also be securely restored, by the biasing force from a biasing device for applying bias, to the initial position at which the next toilet flush operation (the discharge valve opening operation) can be started.

As a result of the above, the operating portion and the rotary portion can respectively both be quickly and securely returned to a position at which the flush toilet operation (the discharge valve opening operation) can be started in preparation for the next toilet flush operation (the discharge valve opening operation) each time a sequence of toilet flush operations is completed.

In the present invention, preferably, wherein the drive unit rotary portion includes a drive-side rotary portion fixed to the rotary shaft, and a slave-side rotary portion configured to follow a drive of the drive-side rotary portion; and wherein the initial position restoration biasing device is disposed on at least either the drive-side rotary portion or the slave-side rotary portion.

According to the invention thus constituted, when the drive-side rotary portion reaches the second operating position together with the rotary windup member, at least the drive-side rotary portion is securely restored to a position at which the next toilet flush operation (the discharge valve opening operation) can be started.

As a result of the above, the operating portion and the rotary portion can respectively both be quickly and securely returned to a position at which the flush toilet operation (the discharge valve opening operation) can be started in preparation for the next toilet flush operation (the discharge valve opening operation) each time a sequence of toilet flush operations is completed.

In the present invention, preferably, wherein the drive-side rotary portion includes a drive-side rotary member fixed to the rotary shaft, and the slave-side rotary portion includes a first slave-side rotary member configured to engage the drive-side rotary member, and a second slave-side rotary member configured to engage the first slave-side rotary member; and wherein the initial position restoration biasing device is disposed on the second slave-side rotary member.

According to the invention thus constituted, when the drive-side rotary portion reaches the second operating position together with the rotary windup member, the slave-side rotary member is securely restored to a position at which the next toilet flush operation (the discharge valve opening operation) can be started.

Simultaneously, the first slave-side rotary member which engages the second slave-side rotary member and the drive-side rotary member which engages this first slave-side rotary member can also be respectively securely restored to initial position at which the next toilet flush operation (the discharge valve opening operation) can be started.

As a result of the above, the operating portion, the drive-side rotary member, the first slave-side rotary member, and the second drive-side rotary member can respectively each be quickly and securely returned to a position at which the flush toilet operation (the discharge valve opening operation) can be started in preparation for the next toilet flush operation (the discharge valve opening operation) each time a sequence of toilet flush operations is completed.

Furthermore, using the drive-side rotary member, the first slave-side rotary member engageable with this drive-side rotary member, and the second slave-side rotary member engageable with this first slave-side rotary member enable each rotary member to be disposed in mutually offset positions within the same plane. Therefore compared to a structure in which each rotary member is mutually disposed in the axial direction of the rotary shaft in the drive unit, space for the drive unit in the axial direction of the rotary shaft can be reduced, and interference with internal equipment, etc. inside the flush water tank disposed in the axial direction of the drive unit rotary shaft can be prevented.

The present invention is a flush water tank device comprising the above operating device.

The invention thus constituted provides a flush water tank device in which the flush water tank device operating portion can be quickly and securely restored to an initial position at which a toilet flush operation (discharge valve opening operation) can be started, in preparation for the next toilet flush operation (discharge valve opening operation) after the end of each sequence of toilet flush operations.

In addition, the present invention is preferably a flush toilet comprising the above flush water tank device.

The invention thus constituted provides a toilet in which the flush water tank device operating portion can be quickly and securely restored to an initial position at which a toilet flush operation (discharge valve opening operation) can be started, in preparation for the next toilet flush operation (discharge valve opening operation) after the end of each sequence of toilet flush operations.

According to the operating device for the flush water tank device of the present invention, the operating portion can be quickly and securely restored to an initial position each time a sequence of toilet flush operations is completed.

DETAILED DESCRIPTION

Below, referring to the attached figures, an operating device for a flush water tank device according to an embodiment of the invention, a flush water tank device including this operating device, and a flush toilet including this flush water tank device are explained.

Figure 1:
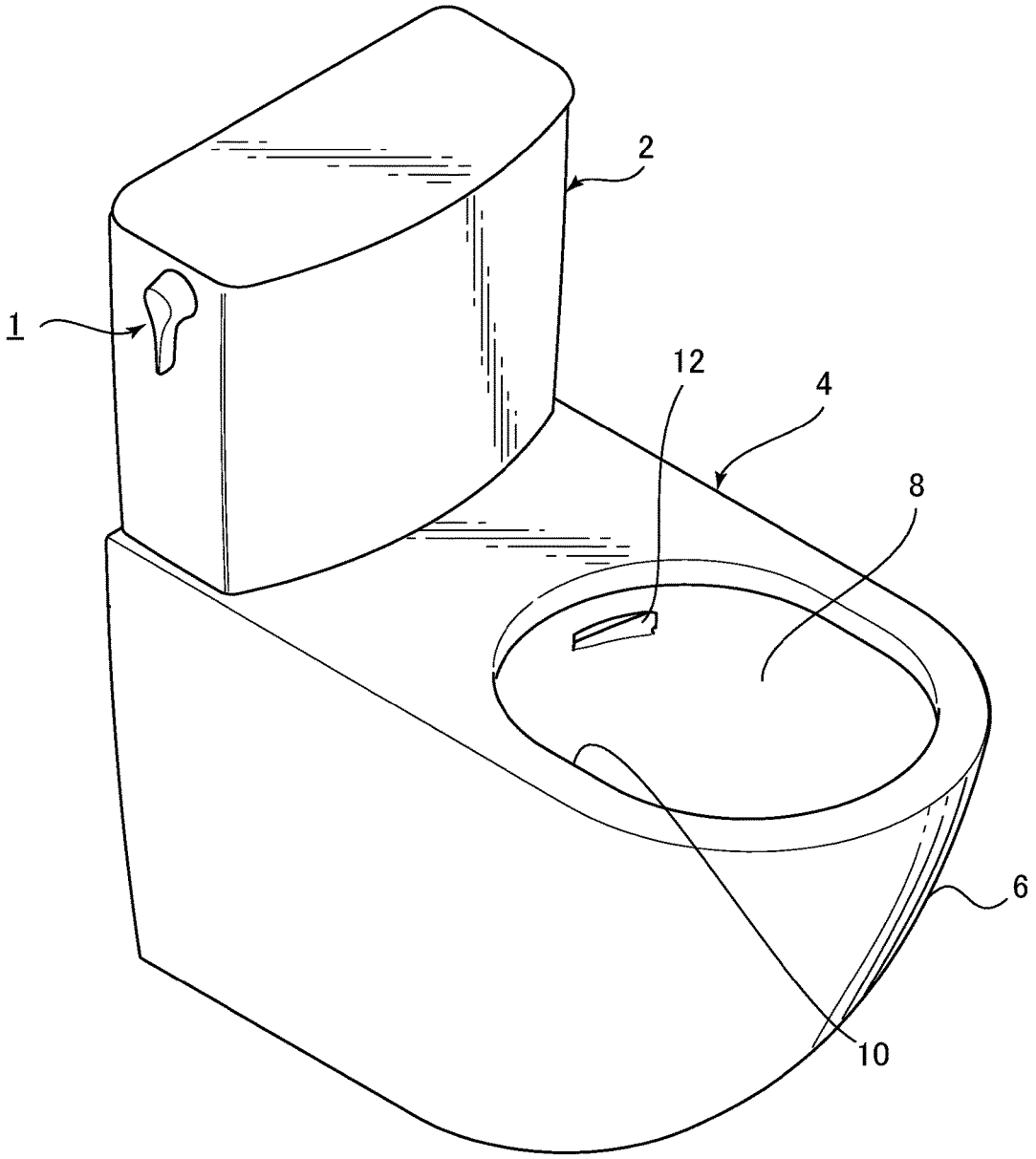
FIG. 1 is a perspective view showing the toilet seat and toilet lid removed in a flush toilet to which a flush water tank device including an operating device according to an embodiment of the invention is applied.

First, referring to FIG. 1, a flush toilet is explained, to which a flush water tank device including a flush water tank device operating device according to an embodiment of the invention is applied.

FIG. 1 is a perspective view showing the toilet seat and toilet lid removed, in a flush toilet to which a flush water tank device is applied, the latter comprising an operating device for a flush water tank device according to an embodiment of the invention.

As shown in FIG. 1, the operating device 1 for a flush water tank device according to an embodiment of the invention is disposed on a flush water tank device 2 in which flush water for toilet flushing is stored, and performs an operation in which flush water is supplied from this flush water tank device 2 to a flush toilet 4 to start a toilet flush.

First, the flush toilet 4, to which is applied the flush water tank device 2, on which the operating device 1 is mounted, is a water-conserving siphon-type flush toilet flushed, for example, with 3.8 liters to 5.2 liters of flush water, and comprising a ceramic toilet main body 6. A bowl portion 8 and a trap pipe (not shown) communicating with the bottom portion of this bowl portion 8 are respectively formed on this toilet main body 6.

An inward-overhanging rim 10 and a spout port 12 for spouting flush water supplied from a conduit (not shown) formed within the rear side of the toilet main body 6 are formed on the top edge portion of the bowl portion 8 of the toilet main body 6, and flush water spouted from this spout port 12 drops down as it circulates, flushing the bowl portion 8.

Moreover, a flush water tank device 2 for storing flush water supplied to the toilet main body 6 is disposed on the top surface at the rear side of the toilet main body 6.

Note that in the present embodiment an example is explained, in which a flush water tank device 2 is applied to what is known as a siphon-type of flush toilet 4, wherein a siphon action is utilized to draw in waste in the bowl portion 8 and discharge all at once from a discharge trap pipe (not shown), but the invention is not limited to this type of siphon flush toilet, and may also be applied to other types of flush toilet such as a wash-down type of flush toilet, in which waste is pushed out by the flow action caused by the water drop inside the bowl portion.

Figure 2:
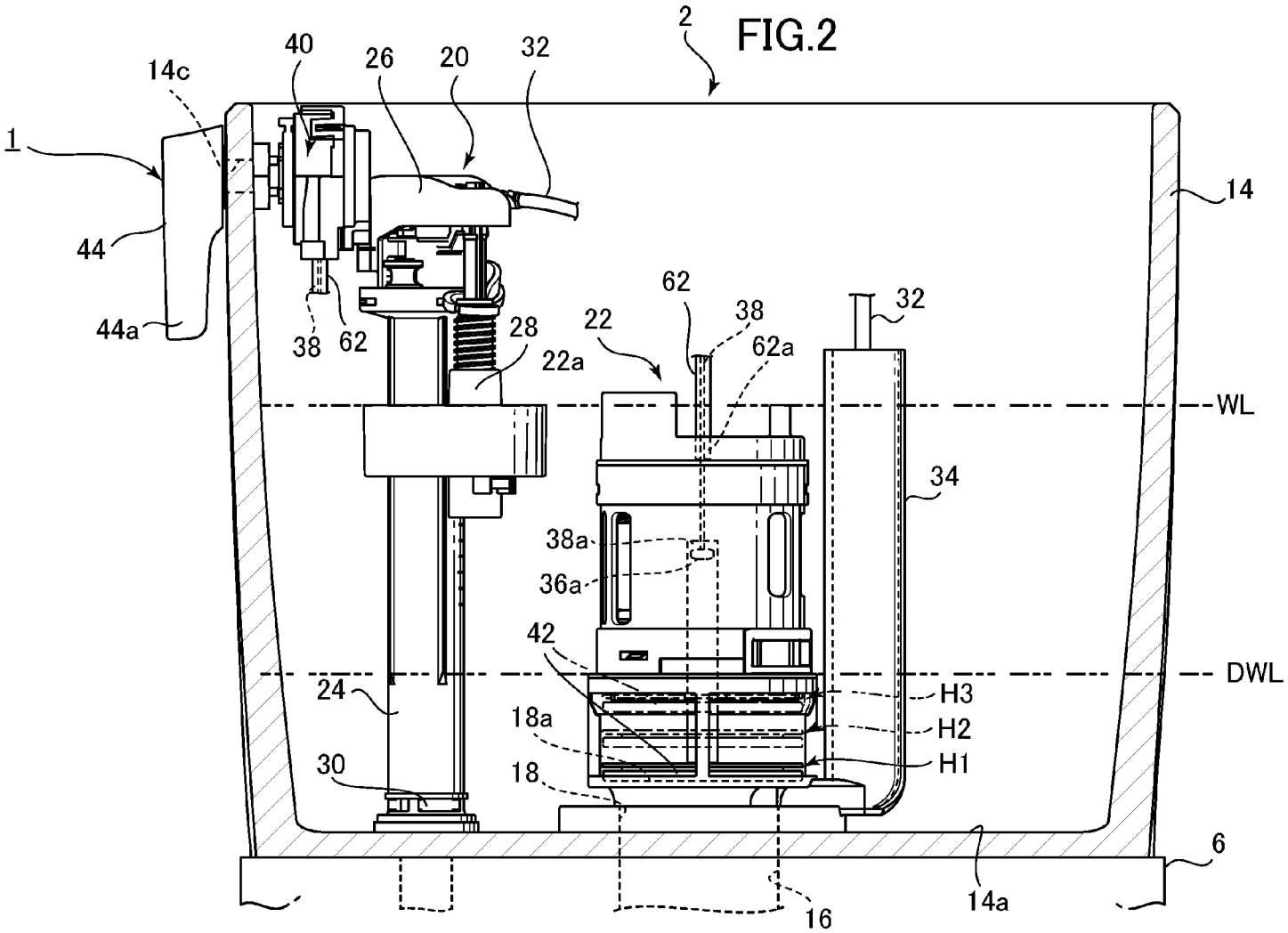
FIG. 2 is a front elevation cross section showing the internal structure of the flush water tank device including the operating device for the flush water tank device according to the embodiment of the invention.

Next, referring to FIG. 2, the internal structure of the flush water tank device 2 is explained.

FIG. 2 is a front elevation cross section showing the internal structure of a flush water tank device including an operating device according to an embodiment of the invention.

As shown in FIG. 2, the flush water tank device 2 includes a storage tank 14 for storing flush water to flush the flush toilet 4; a discharge path 18 communicating with a conduit 16 on the toilet main body 6 is formed at the bottom portion 14*a* of this storage tank 14, and flush water in the storage tank 14 is supplied to the toilet main body 6 conduit 16. The amount of flush water stored by the storage tank 14 varies depending on toilet type.

As shown in FIG. 2, a water supply device 20 for supplying flush water into this storage tank 14 and a discharge valve device 22 for allowing flush water in the storage tank 14 to flow out to the toilet main body 6 conduit 16 by opening the discharge port 18*a* formed on the top edge portion of the discharge path 18 are disposed within the storage tank 14 on the flush water tank device 2.

The water supply device 20 includes: a water supply pipe 24 connected to an external water supply source (not shown) and extending upward from the bottom portion of the storage tank 14, a water supply valve 26, attached to the top edge portion of this water supply pipe 24, for switching between spouting and shutting off flush water supplied from the water supply pipe 24 into the storage tank 14, and a float 28, which moves up and down with fluctuations in the water level inside the storage tank 14 and switches between spouting and shutting off water by the water supply valve 26.

A spout port 30 is opened on the outer circumference-side bottom end portion of the water supply pipe 24, and flush water from the water supply valve 26 is spouted into the storage tank 14 from this spout port 30.

The water supply device 20 includes a refill pipe 32 connected to the water supply valve 26; at the downstream end portion of this refill pipe 32, a portion of the refill pipe 32 is affixed to a predetermined location on the overflow pipe 34 or in the storage tank 14 so as to be positioned close to the top end opening on the overflow pipe 34 of the discharge valve device 22.

The discharge valve device 22 causes an amount of flush water in the storage tank 14 corresponding to the difference between the predetermined water level during a flush and the stop water level (or dead water level) DWL below that to be discharged to the toilet; in the water supply device 20, the flush water level falls and the float 28 drops; this causes the water supply valve 26 to open so that spouting from the spout port 30 starts and spouting into the storage tank 14 from a supply source (not shown) outside the flush water tank device 2 is started.

In addition, when spouting is continued and the water level inside the storage tank 14 rises, the float 28 rises so that the water supply valve 26 closes, and spouting from the spout port 30 is shut off. The flush water level inside the storage tank 14 is by this means maintained at a predetermined water level WL when full.

Next, the discharge valve device 22 is a direct drive-type of discharge valve device including a discharge valve main body 36 for opening and closing a discharge port 18*a* by rising and falling. This direct drive type discharge valve device 22 has the same constitution as a conventional discharge valve device, so a specific explanation thereof is here omitted, but one end portion 38*a* of the operating device 1 operating wire 38, described in detail below, is linked to the top end portion 36*a* of the discharge valve main body 36, and the other end portion 38*b* of the operating wire 38 is linked to a part of the operating device 1 drive unit 40, described in detail below.

The amount by which the operating wire 38 moves corresponds to the amount of movement up or down by the valve body 42 at the bottom end portion of the discharge valve main body 36; when the operating handle 44, being the operating portion for the operating device 1 toilet flushing operation described in detail below, is driven by a drive unit 40 as the result of a user turning the operating handle 44, the operating wire 38 pulled up, thereby pulling up the valve body 42 and opening the discharge port 18*a* for a predetermined time, so that a fixed amount of flush water in the storage tank 14 is discharged from the discharge port 18*a* through the discharge path 18 to the toilet main body 6 conduit 16 to perform a toilet flush.

FIG. 2 shows by a solid line the discharge valve main body 36 valve body 42, in which the discharge port 18*a* is in a closed state at valve closed position H1. The discharge valve main body 36 valve body 42 with the discharge port 18 an opened at a valve mid-opening position H2 above valve closed position H1, and the discharge valve main body 36 bead chain 52 with the discharge port 18 an opened at the highest valve open position (fully open position) H3, which is above the valve mid-opening position H2 and fully open, are respectively shown by dot-and-dash lines.

Figure 3:
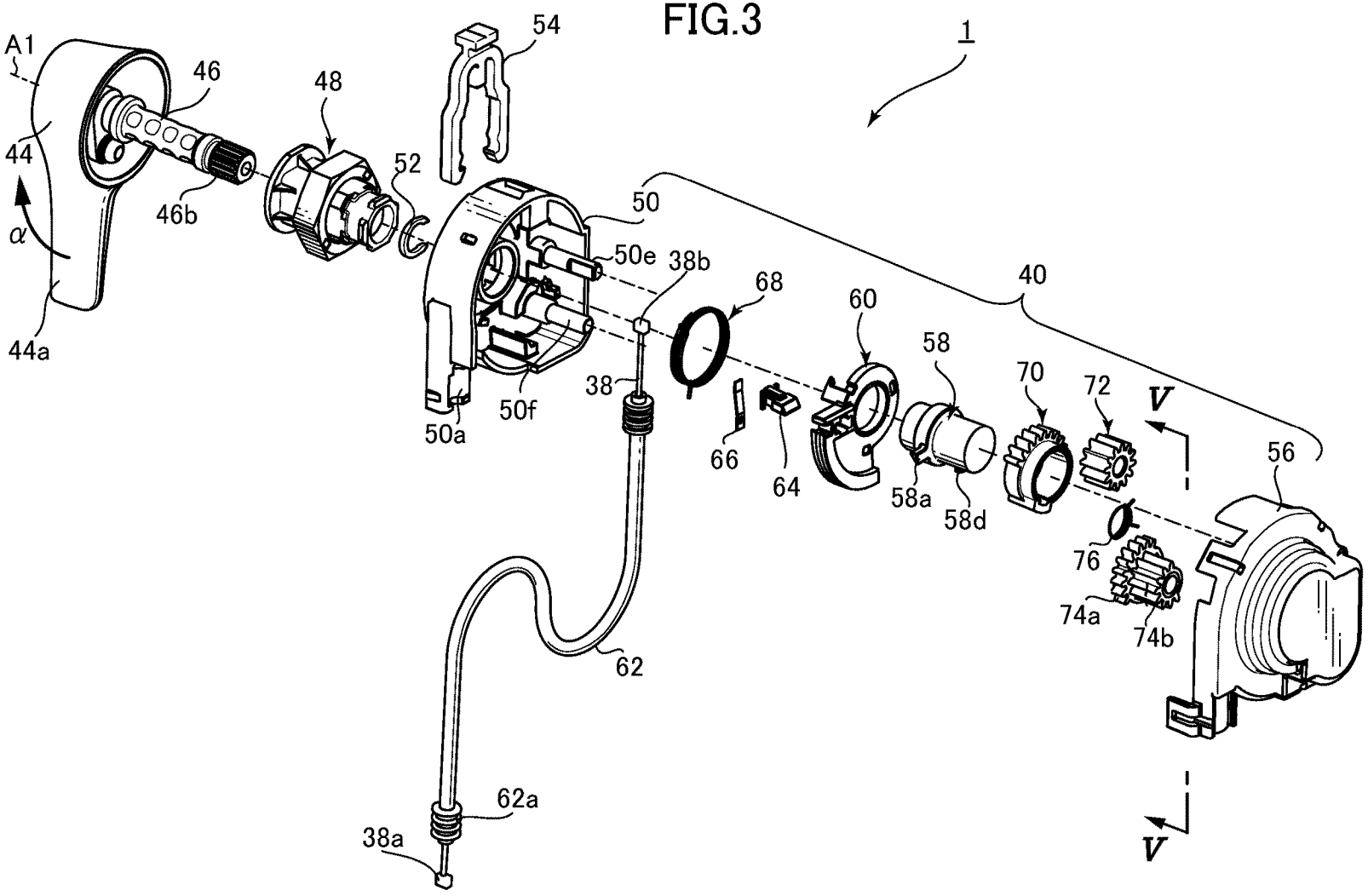
FIG. 3 is an exploded perspective view showing the operating device for the flush water tank device according to the embodiment of the invention.
Figure 4:
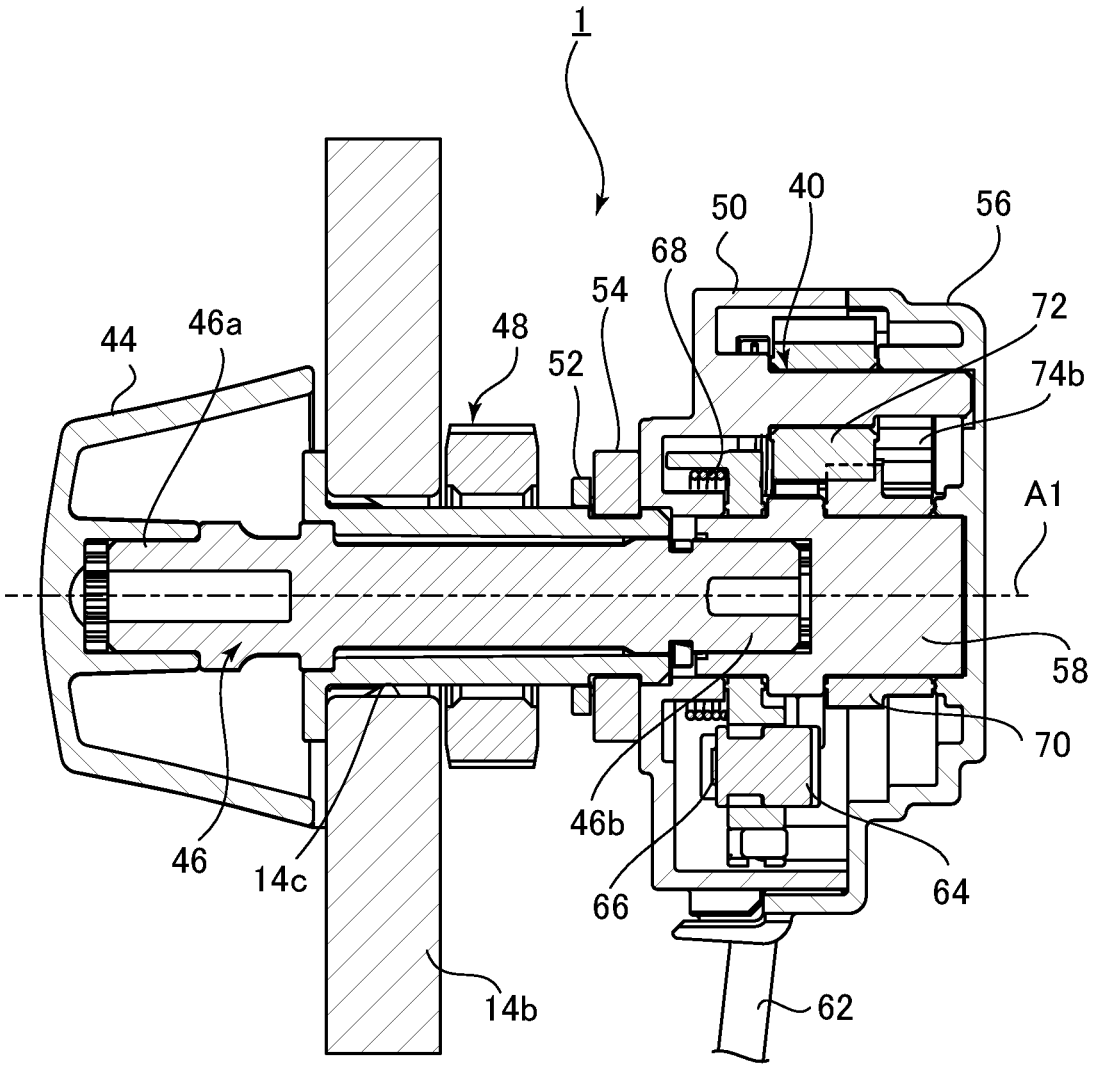
FIG. 4 is a plan view cross section showing an operating device for the flush water tank device according to the embodiment of the invention.

Next, referring to FIGS. 2 through 4, an operating device for a flush water tank device according to an embodiment of the invention is explained in detail.

First, FIG. 3 is an exploded perspective view showing an operating device for a flush water tank device according to an embodiment of the invention, and FIG. 4 is a plan view cross section showing an operating device for a flush water tank device according to an embodiment of the invention.

As shown in FIGS. 2 through 4, the operating device 1 according to an embodiment of the invention comprises a rotary shaft 46, which extends so as to penetrate from the inside to the outside of the storage tank 14; this rotary shaft 46 is inserted into an attaching hole 14*c* formed to penetrate horizontally into the side wall portion 14*b* to the left and above as seen from the toilet front on the outside of the storage tank 14, and is rotatably attached.

An operating handle 44 is affixed and attached to the outside end portion 46*a* of the rotary shaft 46 positioned outside the storage tank 14, and this operating handle 44 is disposed on the left side portion of the storage tank 14 as seen from the front side of the toilet. By the gripping portion 44*a* extending downward from the operating handle 44 and pulling it toward the front as seen from the front side of the flush water tank device 2 and causing the operating handle 44 to rotate in the forward direction $\alpha$, which is the predetermined valve opening direction, the rotary shaft 46 is able to rotate about the center axial line A1 of the rotary shaft 46 as one piece with the operating handle 44 and thereby function as a "pull-type operating handle."

Moreover, as shown in FIGS. 3 and 4, the operating device 1 comprises a support member 48, placed between the operating handle 44 and the attaching hole 14*c* on the storage tank 14 side wall portion 14*b* for rotatably supporting the rotary shaft 46, and fasteners 52, 54, for affixing this support member 48 and the drive unit 40 casing 50.

Next, as shown in FIGS. 3 and 4, the drive unit 40 comprises a casing 50 and a cover member 56, attached so as to cover this casing 50. A rotary member 58 on the drive side (details described below), being a rotary portion affixed to the rotary shaft 46, and a rotary windup member 60 (details described below) are provided as an internal structure disposed between this casing 50 and the cover member 56, and the other end portion 38*b* of the operating wire 38 extending from the tube 62 is linked to a part of this rotary windup member 60 (details described below).

Also, as shown in FIGS. 3 and 4, a locking projection 64 (details below) and a thin plate spring 66 (details below), being a locking device mounted on the rotary windup member 60 for locking the rotary windup member 60 to the rotary member 58, are disposed as an internal structure of the drive unit 40, and a return spring 68 (details below) is disposed on the rear surface side of the rotary windup member 60.

In addition, as shown in FIGS. 3 and 4, a first gear 70 (details below), being a drive-side rotary member attached to the drive-side rotary member 58 and affixed to the rotary shaft 46, a second gear 72 (details below), being a first slave-side rotary member capable of engaging with this first gear 70, and a third gear 74 (details below), being a second slave-side rotary member capable of engaging with this second gear 72, are provided as an internal structure of the drive unit 40.

Also, as shown in FIGS. 3 and 4, a return spring 76 (details below) is placed on the axial direction rear surface side of the large gear 74*a* on the third gear 74.

Figure 5:
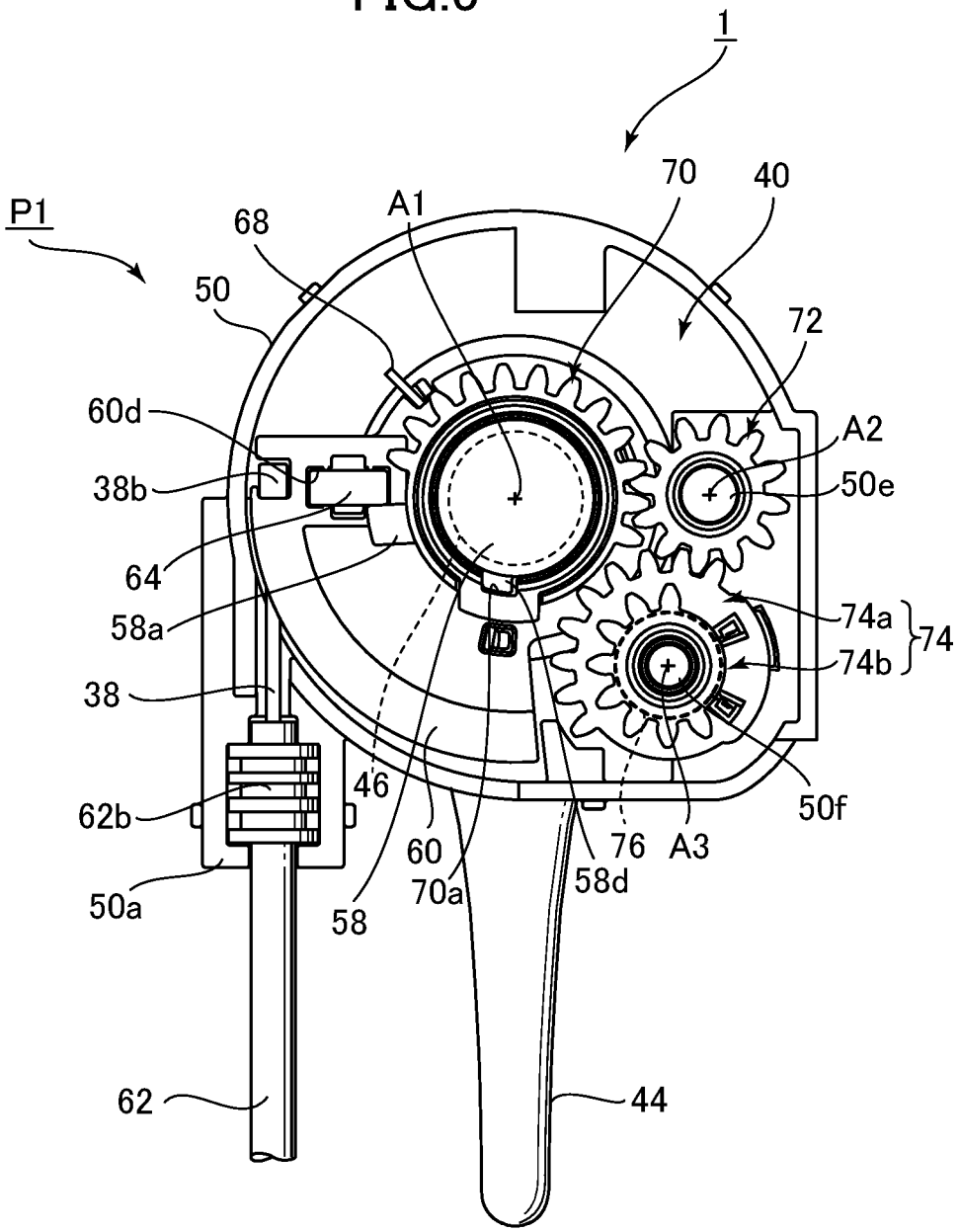
FIG. 5 is a cross sectional diagram along line V-V in FIG. 3, showing the standby state before start of operation and after completion of operation, whereby in the operating handle, drive unit, and operating wire for an operating device on the flush water tank device according to the embodiment of the invention, the discharge valve main body is in a closed state.
Figure 6:
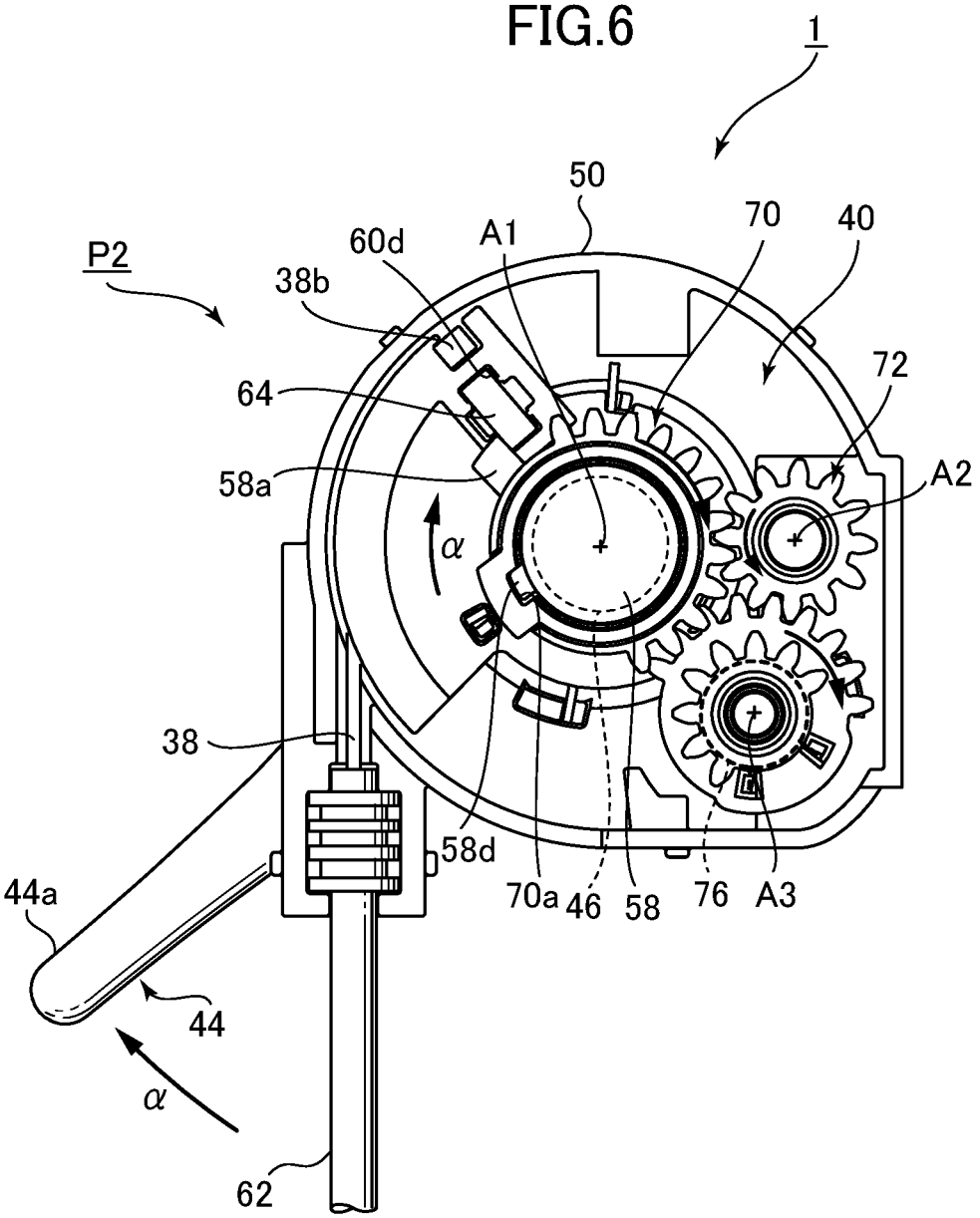
FIG. 6 is a cross section similar to FIG. 5, showing the operating state when a discharge valve main unit is in the midst of opening, in an operating handle, drive unit, and operating wire for an operating device on the flush water tank device according to the embodiment of the invention.
Figure 7:
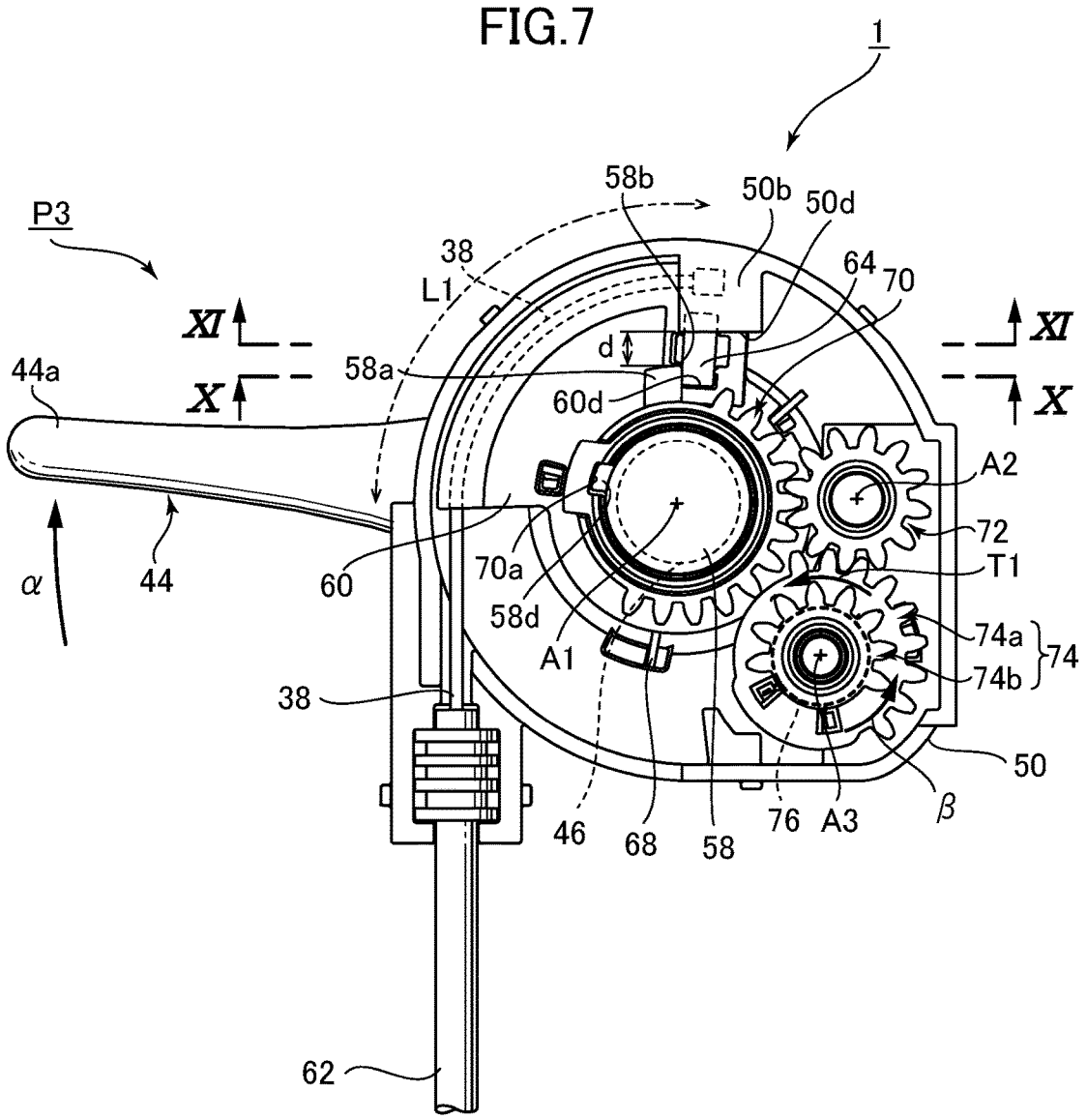
FIG. 7 is a cross section similar to FIG. 5, showing the operating state when a discharge valve main unit has fully opened, in an operating handle, drive unit, and operating wire for an operating device on the flush water tank device according to the embodiment of the invention.

Next, FIG. 5 is a cross sectional diagram along line V-V in FIG. 3, showing the standby state before start of operation and after completion of operation, whereby in the operating handle, drive unit, and operating wire for an operating device on a flush water tank device according to an embodiment of the invention, the discharge valve main body is in a closed state; FIG. 6 is a cross section similar to FIG. 5, showing the operating state when a discharge valve main unit is in the midst of opening, in an operating handle, drive unit, and operating wire for an operating device on a flush water tank device according to an embodiment of the invention; FIG. 7 is a cross section similar to FIG. 5, showing the operating state when the discharge valve main unit has fully opened, in an operating handle, drive unit, and operating wire for an operating device on a flush water tank device according to an embodiment of the invention.

As shown in FIGS. 2 through 5, the drive unit 40 on the operating device 1 is attached to the inside end portion 46*b* of the rotary shaft 46 positioned on the inside of the storage tank 14, and to the inside end portion of the support member 48.

As shown in FIG. 2 and FIGS. 5 through 7, with respect to the operating wire 38, the drive unit 40, by the rotary operation of the operating handle 44, is able to move from the standby state operating position P1 prior to start of operation, which corresponds to the valve closed position H1 (see FIG. 2) on the discharge valve main body 36 valve body 42—i.e., from the initial position P1 at which a toilet flush operation can be started—through operating position P2 (see FIG. 6) corresponding to the valve mid-opening position P2 on the valve body 42 of the discharge valve main body 36, then to an operating position P3 (see FIG. 7) corresponding to the fully open position H3 (see FIG. 2) on the valve body 42 of the discharge valve main body 36.

Next, as shown in FIGS. 3 through 7, the drive unit 40 rotary member 58 is built into the casing 50 and the cover member 56 and is affixed to the inside end portion 46*b* of the rotary shaft 46.

Note that in this embodiment, a form is explained, in which the rotary shaft 46 and the rotary member 58 are separate members, but both 46 and 58 may be a single piece integrated member.

Also, as shown in FIGS. 3 through 7, the drive unit 40 rotary windup member 60 is a pulley, attached to be rotatable about the center axial line A1 relative to the rotary member 58, with the other end portion 38*b* of the operating wire 38 linked thereto, so that rotating it in the forward rotational direction α (the clockwise (right rotation) direction as seen in the plan view shown in FIG. 6) results in a predetermined amount of the operating wire 38 being wound.

This rotary member 58 and rotary windup member 60 can be moved by rotary operation of the operating handle 44 from the operating position P1 in the standby state prior to start of operation (see FIG. 5) through midway operating position P2 (see FIG. 6) to operating position P3 (see FIG. 78).

Figure 8:
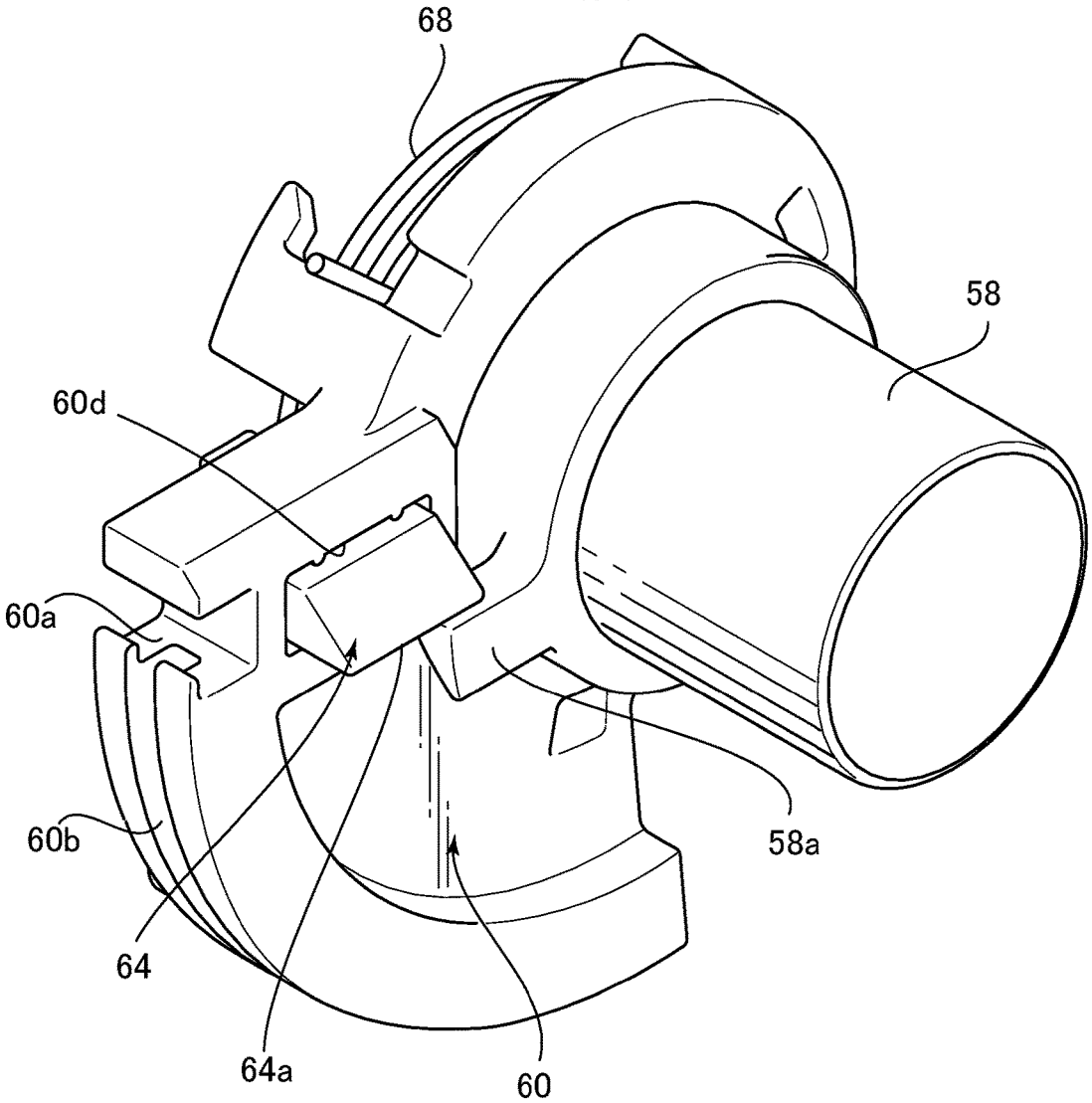
FIG. 8 is a perspective seen from the axial direction inner side (front side) of the drive unit drive-side rotary member and rotary windup member in an operating device for the flush water tank device according to the embodiment of the invention.
Figure 9:
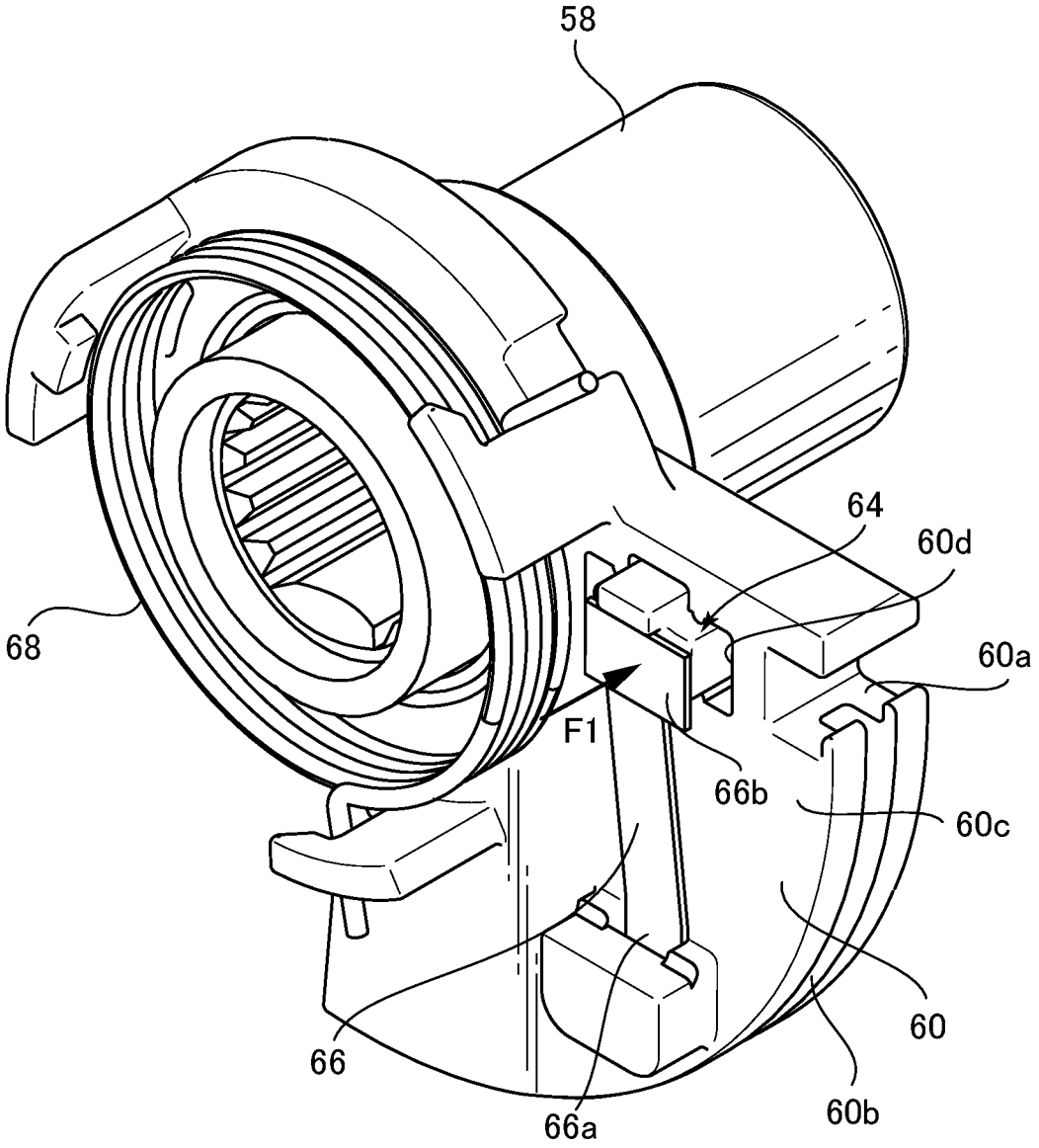
FIG. 9 is a perspective seen from the axial direction outer side (rear side) of the drive unit drive-side rotary member and rotary windup member, respectively, in an operating device for the flush water tank device according to the embodiment of the invention.

Next, FIG. 8 is a perspective view seen from the axial direction inner side (front side) of the drive unit drive-side rotary member and rotary windup member, respectively, in an operating device for a flush water tank device according to a first embodiment of the invention; FIG. 9 is a perspective view seen from the axial direction outer side (rear side) of the drive unit drive-side rotary member and rotary windup member, respectively, in an operating device for a flush water tank device according to a first embodiment of the invention.

As shown in FIGS. 2 through 9, the operating wire 38 is made of a metal such as stainless steel, and can be passed through the flexible tube 62 and slide relative to this tube 62.

Also, one end portion 62*a* of the tube 62 is connected to the top end portion of the exterior casing 22*a* on the discharge valve device 22 (see FIG. 2) and affixed; the other end portion 62*b* of the tube 62 is connected to the tube connecting portions 50*a*, 56*a* (see FIGS. 3 and 5) disposed at the bottom of the side wall portion of the casing 50 and the cover member 56 and affixed.

Furthermore, as shown in FIGS. 5 through 9, the other end portion 38*b* of the operating wire 38 extending to the outside from the other end portion 62*b* of the tube 62 is formed in a projecting shape, and is inserted and fit into an attaching hole 60*a* for the operating wire, disposed close to the front end portion in the forward rotational direction α on the outer circumferential portion of the approximately fan-shaped rotary windup member 60.

Also, as shown in FIGS. 8 and 9, on the outer circumferential portion of the rotary windup member 60, a guide channel 60*b* is formed along the circumferential direction to guide the operating wire 38 along the circumferential direction. When the rotary windup member 60 is moved together with the rotary member 58 by the rotary operation of the operating handle 44 from the standby state operating position P1 (see FIG. 5) through the midway operating position P2 (see FIG. 26) to the operating position P3 (see FIG. 7), the operating wire 38 is wound by a predetermined winding amount along the guide channel 60*b* and moves relative to the tube 62, to that extent raising the valve main body 36 valve body 42 by a predetermined amount.

For example, if the operating wire 38 is wound by a maximum winding amount L1 by the rotary windup member 60, as shown in FIG. 7, the discharge valve main body 36 valve body 42 rises to the maximum valve opening position (fully open position) H3, as shown in FIG. 2.

Note that the rotary member 58 and rotary windup member 60 shown in FIGS. 5 and 6 are shown in a mutually locked state; the rotary member 58 and rotary windup member 60 shown in FIG. 7 are shown in a state immediately prior to releasing the mutual lock.

Also, as shown in FIG. 9, the thin plate spring 66 comprises: at one end an affixing end portion 66*a*, affixed to the rear surface 60*c* of the rotary windup member 60, and at the other end a free end portion 66*b* to which the locking projection 64 is attached.

Also, as shown in FIGS. 4 through 9, an attaching hole 60*d* for a locking projection Here, with the locking projection 64 inserted into the attaching hole 60*d*, from the free end portion 66*b* of the thin plate spring 66 relative to the locking projection 64, a biasing force F1 (see FIG. 9) is constantly acting in the axial direction from the rear surface side toward the front side of the rotary windup member 60. Thus until the rotary member 58 and the rotary windup member 60 rotates in the forward rotational direction α from the operating position P1 (see FIG. 5) through the operating position P2 (see FIG. 6) and reaches the operating position P3 (see FIG. 7), the front end portion 62*a* of the locking projection 64 is caused by the biasing force F1 to project from the rotary windup member 60 attaching hole 60*d*.

Next, as shown in FIGS. 3 through 9, the rotary member 58 comprises a locking projecting portion 58*a* formed to project radially outward from a portion of the outer circumferential portion thereof.

With the tip portion 64*a* of the locking projection 64 projecting from the rotary windup member 60 attaching hole 60*d*, contact by the front end portion in the forward rotational direction ax of the projecting portion 58*a* for locking the rotary member 58 with the back end side of the tip portion 64*a* of the locking projection 64 results in mutual locking of the rotary windup member 60 and the rotary member 58.

Figure 10:
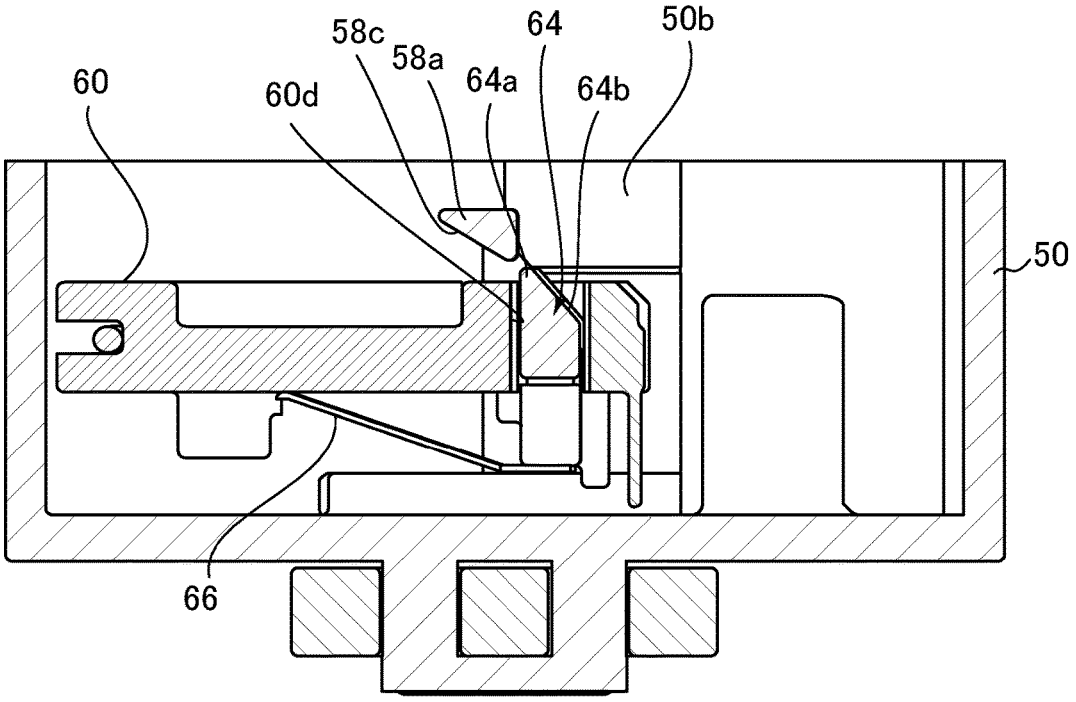
FIG. 10 is a cross sectional diagram along line X-X in FIG. 7.
Figure 11:
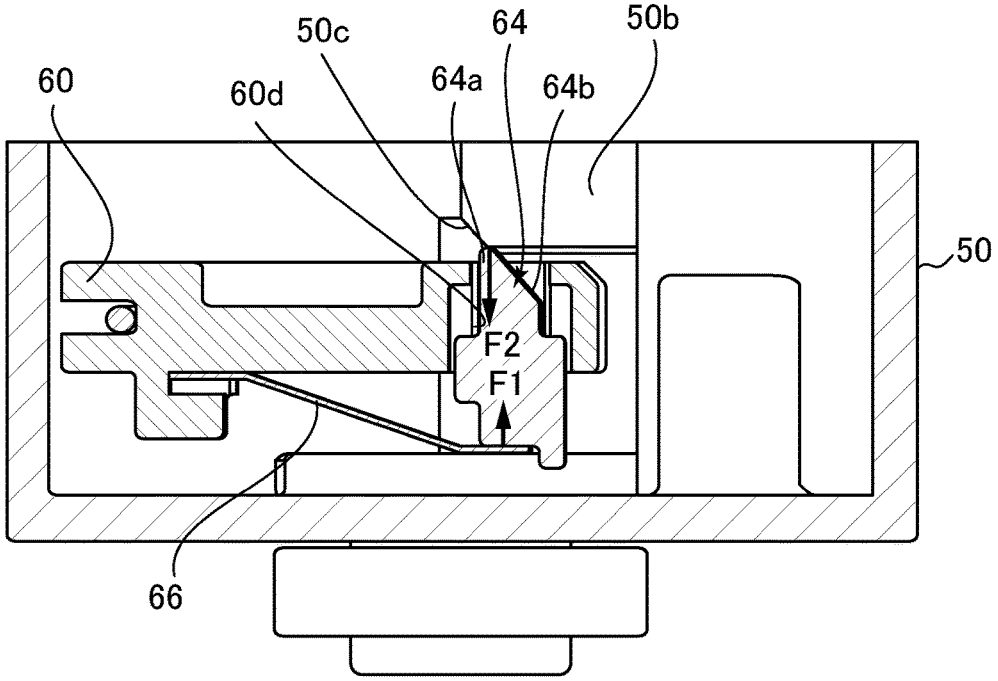
FIG. 11 is a cross section along line XI-XI in FIG. 7.

Next, FIG. 10 is a cross sectional diagram along line X-X in FIG. 7, and FIG. 11 is a cross sectional diagram along line XI-XI in FIG. 7.

As shown in FIGS. 7, 10, and 11, a lock release projecting portion 50*b* is placed in the casing 50, for releasing the lock between the rotary windup member 60 and the rotary member 58 by engaging with the locking projection 64 when the rotary windup member 60 reaches operating position P3.

When the rotary member 58 and the rotary windup member 60 rotate in the forward rotational direction α from operating position P1 (see FIG. 5) through operating position P2 (see FIG. 6) and reach operating position P3 (see FIG. 7), the sloped surface 64*b* on the forward rotational direction α front side of the tip portion 64*a* on the locking projection 64, by contacting the sloped surface 50*c* at the lower side and rear side of the lock release projecting portion 50*b* and the 60 as shown in FIG. 11, causes the locking projection 64 to be pushed downward by the lock release projecting portion 50*b*.

At this point, at the locking projection 64 the downward pressing force F2 shown in FIG. 11 from the lock release projecting portion 50*b* exceeds the upward biasing force F1 shown in FIG. 11 from the thin plate spring 66, therefore the locking projection 64 tip portion 64*a* retracts from a projected state into the attaching hole 60*d*, and the lock with the rotary member 58 locking projecting portion 58*a* (see FIG. 10) is released.

Also, as shown in FIG. 7, the top end 58*b* of the locking projecting portion 58*a* on the rotary member 58 engaged with the locking projection 64 at operating position P3 and the bottom end portion 50*d* of the lock release projecting portion 50*b* in the casing 50 are mutually separated by a predetermined distance d in the vertical direction.

By so doing, the engaging part of the locking projection 64 engaged with the locking projecting portion 58*a* on the rotary member 58 and the locking projection 64 engaged with the lock release projecting portion 50*b* on the casing 50 are mutually separated, therefore the rotary member 58 locking projecting portion 58*a* and the casing 50 lock release projecting portion 50*b* can be prevented from mutually colliding.

Figure 12:
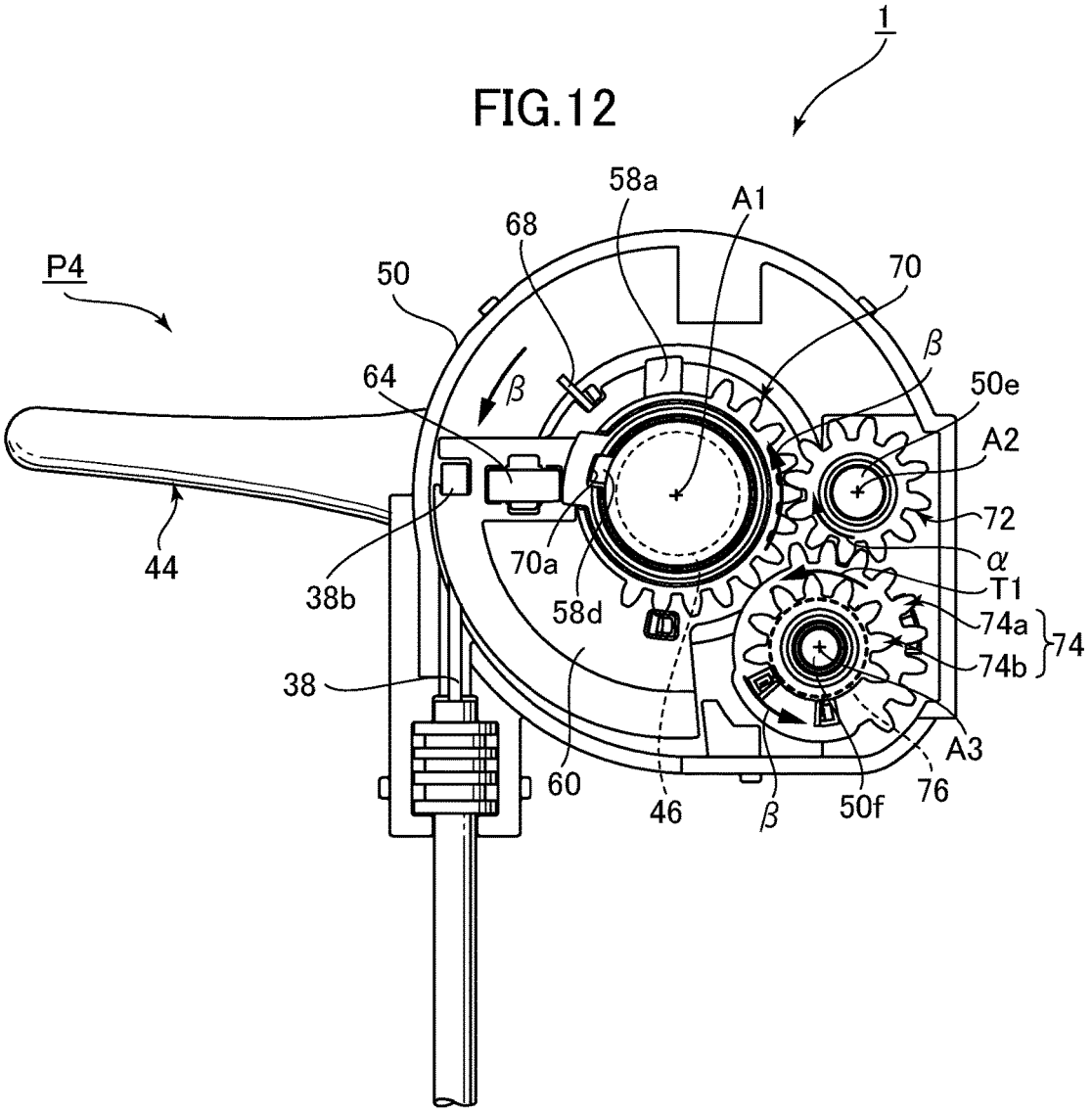
FIG. 12 is a cross sectional diagram similar to FIG. 5, showing the state in an operating handle, drive unit, and operating wire for an operating device on the flush water tank device according to the embodiment of the invention in which the lock between the drive unit drive-side rotary member and the rotary windup member is released and only the rotary windup member is restored to the standby state.

Next, FIG. 12 is a cross sectional diagram similar to FIG. 5, showing the state in an operating handle, drive unit, and operating wire for an operating device on a flush water tank device according to an embodiment of the invention in which the lock between the drive unit rotary member and the rotary windup member is released and only the rotary windup member is restored to the standby state.

As shown in FIGS. 3, 4, 8, and 9, the drive unit 40 comprises a return spring 68 placed on the rear surface side of the rotary windup member 60; this return spring 68 is a helical coil spring, one end of which is affixed to part of the inside of the casing 50.

Note that in the present embodiment, a form is explained, in which a return spring 68 comprised of a helical coil spring is employed, however spring elements other than helical coils may also be used.

When the rotary windup member 60 rotates in the forward rotational direction α from operating position P1 (see FIG. 5) through operating position P2 (see FIG. 6) and reaches operating position P3 (see FIG. 7) so that the lock between the rotary windup member 60 and the rotary member 58 is released, the rotary windup member 60 is biased so as to rotate in the reverse rotational direction β, which is the predetermined valve closing direction, therefore only the rotary windup member 60 rotates in the reverse rotational direction (3 (the counterclockwise (left rotation) direction as seen in the plan view shown in FIG. 12), which is the opposite direction to forward rotational direction α, and can thus return to the standby state operating position P4 (see FIG. 12).

I.e., when the lock between the rotary windup member 60 and the rotary member 58 is released, then even if the operating handle 44 and rotary member 58 operating position P4 is maintained at the same position as the operating position P3 of the operating handle 44 and the rotary member 58 shown in FIG. 7, only the rotary windup member 60 and operating wire 38 will be able to return to the standby state operating position P4, regardless of the operating position of such operating handle 44 or rotary member 58, therefore the discharge valve main body 36 valve body 42 drops down to the valve closed position H1 (see FIG. 2) with the drop in the water level inside the storage tank 14, so that the discharge port 18*a* can be shut off.

Next, as shown in FIG. 10, the surface of the rotary member 58 locking projecting portion 58*a* on the rear side and lower side toward the forward rotational direction α forms a sloping surface 58*c*. Thus after the lock between the rotary member 58 and the rotary windup member 60 is released at operating position P3 as shown in FIGS. 7 and 10 and the rotary windup member 60 returns to operating position P4 as shown in FIG. 12, and furthermore the rotary member 58 returns to the standby state operating position P1 as shown in FIG. 5, the sloping surface 58*c* on the rotary member 58 locking projecting portion 58*a* faces and engages with the locking projection 64 sloped surface 64*b*, pressing on the locking projection 64 in opposition to the biasing force F1 of the thin plate spring 66, so that the rotary member 58 locking projecting portion 58*a* is able to pass over on the rear side of the locking projection 64 facing in the forward rotational direction α (the bottom side of the locking projection 64 in FIG. 5).

Next, referring to FIGS. 3 through 7 and FIGS. 12 through 14, the first gear 70, second gear 72, third gear 74, and return spring 76 in the drive unit 40 in the operating device 1 of the present embodiment are explained specifically.

Figure 13:
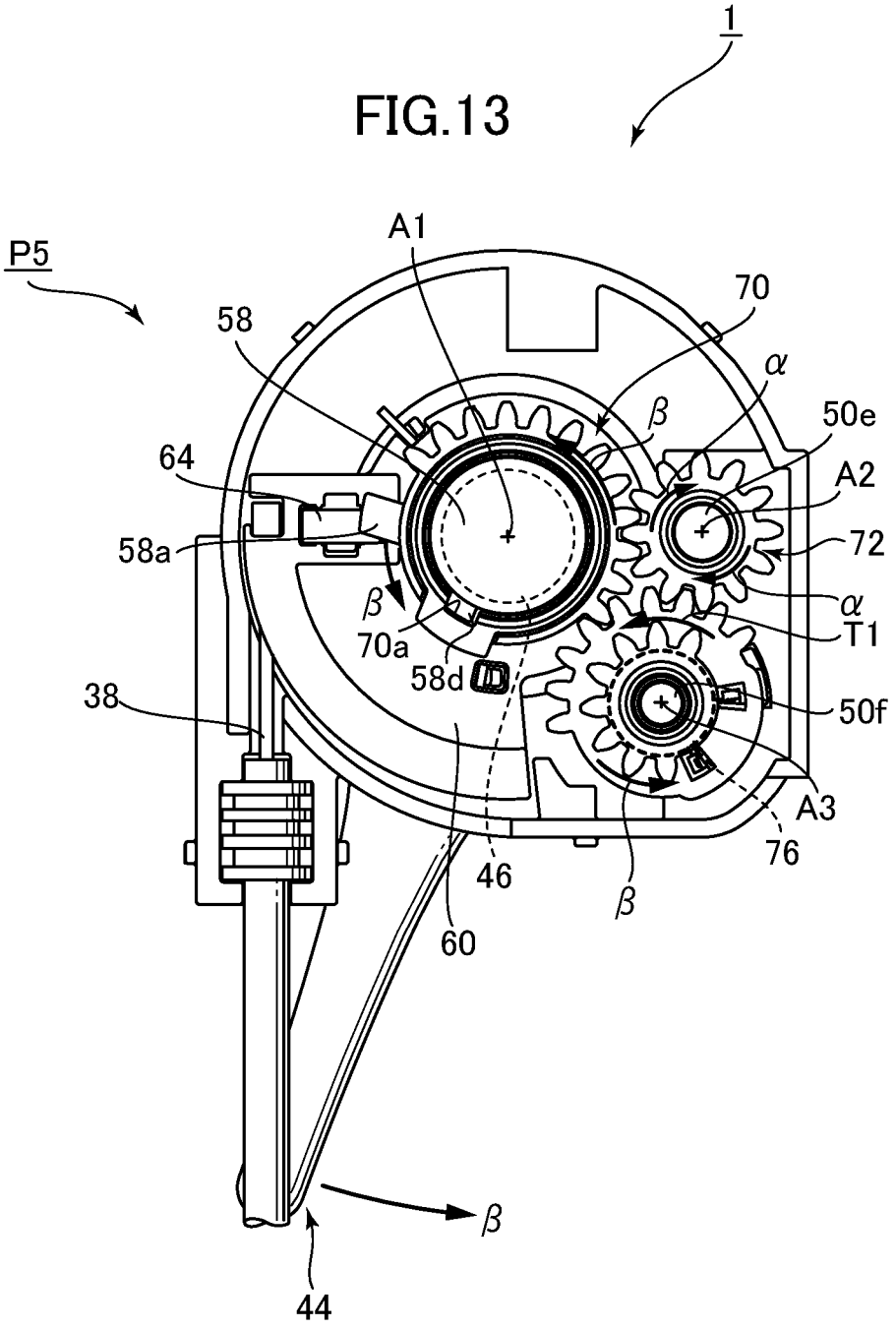
FIG. 13 is a cross sectional diagram similar to FIG. 5, showing the state immediately before a locking projection portion passes over a locking projection on the rotary windup member side after the lock between the drive unit drive-side rotary member and the rotary windup member is released and only the rotary windup member is restored to a standby state in an operating handle, drive unit, and operating wire for an operating device on the flush water tank device according to the embodiment of the invention.

FIG. 13 a cross sectional diagram similar to FIG. 5, showing the state immediately before a locking projection portion passes over a locking projection on the rotary windup member side after, in an operating handle, drive unit, and operating wire for an operating device on a flush water tank device according to an embodiment of the invention, the lock between the drive unit drive-side rotary member and the rotary windup member is released and only the rotary windup member is restored to the standby state.

Figure 14:
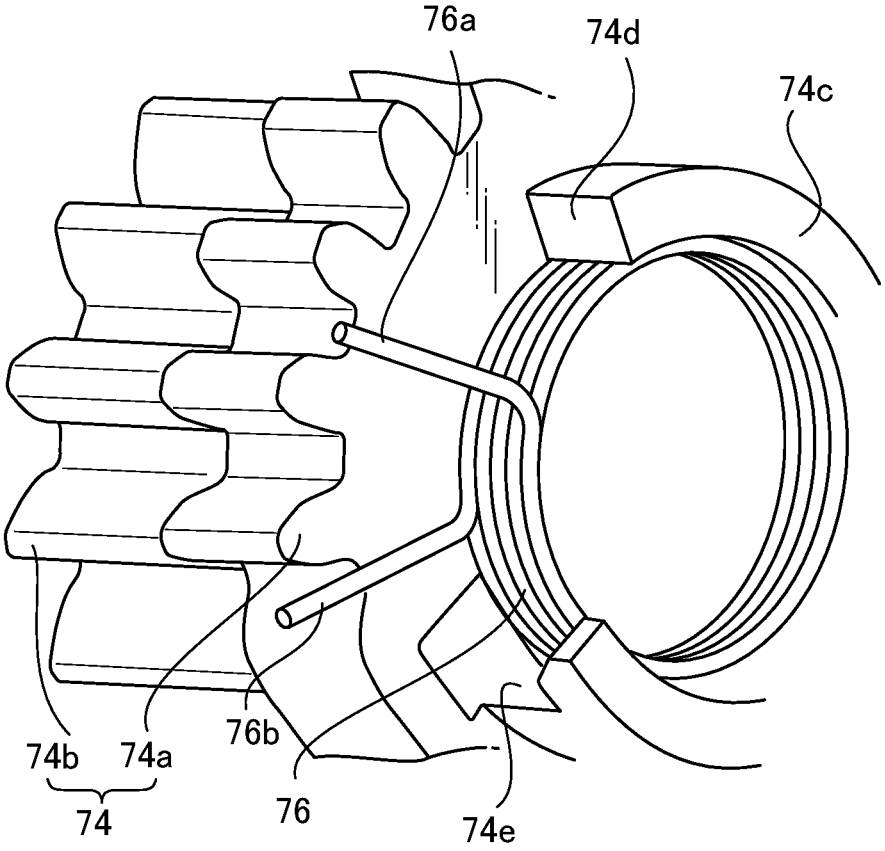
FIG. 14 is a simplified perspective view seen from the axial direction outer side (rear surface side) of a return spring assembled onto the second gear of the drive unit in a conduit for the flush water tank device according to the embodiment of the invention.

Also, FIG. 14 is a simplified perspective view seen from the axial direction outer side (rear surface side) of a return spring assembled onto the second gear of the drive unit in a conduit for a flush water tank device according to an embodiment of the invention.

First, as shown in FIGS. 3 through 7 and FIGS. 12 through 14, the first gear 70 is attached to the end side in the axial direction of the rotary member 58 relative to the locking projecting portion 58*a* on the outer circumferential surface of the approximately cylindrical drive-side rotary member 58.

As shown in FIG. 3, FIGS. 5-7, and FIGS. 12 and 13, an additional radially outwardly projecting mating projection 58*d* is formed in one part of the outer circumferential surface of the rotary member 58, in addition to the locking projecting portion 58*a*.

Also, a mating key channel 70*a* extending in the axial direction is formed on the inner circumferential surface of the first gear 70 opposing the rotary member 58 projection 58*d*, and with the first gear 70 attached to the outer circumferential surface of the rotary member 58, the first gear 70 is affixed to the rotary member 58 by the mutual engagement of the rotary member 58 projection 58*d* and the first gear 70 mating key channel 70*a* so that this first gear 70 and rotary member 58 are able to rotate as one unit.

Note that in the present embodiment, a form is explained, in which the rotary shaft 46, the drive side rotary member 58, and the first gear 70 are each mutually independent members, but a drive-side rotary member formed as a single unit of these three members may be employed, as may a drive side rotary member in which a rotary member 58 other than the rotary shaft 46 is formed as one piece with the first gear 70.

Next, as shown in FIGS. 3 through 7 and 12 through 14, the second gear 72 is attached so as to rotate inside the casing 50 about a center axial line A2 in a shaft portion 50*e* formed to extend in a direction parallel to the axial direction of the rotary shaft 46. This second gear 72 is disposed so that it can only mesh with the first gear 70.

Also, as shown in FIGS. 3 through 7 and 12 through 14, the third gear 74 is attached so as to rotate about a center axial line A3 in the shaft portion 50*f* formed to extend in a direction parallel to the axial direction of the shaft portion 50*e* and the rotary shaft 46. This third gear 74 comprises a large gear 74*a* disposed to mesh only with the second gear 72, and a small gear 74*b* integrally formed on the tip side of the shaft portion 50*f* relative to this large gear 74*a*.

Also, in the present embodiment, it is true that the small gear 74*b* on the third gear 74 does not mesh with either of the other gears 70 or 72, but if the first gear 70 and/or second gear 72 are changed to gears (not shown) with different specifications in accordance with the drive unit 40 specifications, the small gear 74*b* may be used as a gear capable of meshing with at least one of these replaced gears (not shown of different specifications.

Next, as shown in FIGS. 3 through 7 and FIGS. 12 through 14, the return spring 76 disposed on the axial rear surface side of the large gear 74*a* on third gear 74 is formed of a helical coil. This return spring 76 is fit into a spring holding portion 74*c* on the third gear 74 formed in a ring shape at the rear surface of the large gear 74*a*.

Further, as shown in FIG. 14, the return spring 76 comprises an arm portion 76*a* at one end, affixed to a part within the casing 50, and an arm 76*b* at the other end, capable of contacting one of either of the contacting portions 74*d*, 74*e* at the two ends in the circumferential direction of the spring holding portion 74*c*, according to the rotational direction of third gear 74 (large gear 74*a*).

When each of the operating handle 44, the rotary shaft 46, and the rotary member 58 reaches the operating position P3 (see FIG. 7), the return spring 76 functions as a biasing device to restore them to the initial position by biasing the third gear 74 so that the operating handle 44, the rotary shaft 46, and the rotary member 58 are returned from operating position P4 (see FIG. 12), through operating position P5 (see FIG. 13), to the initial position (initial position P1) at which the toilet flushing operation can be started.

I.e., a torsion moment T1 seeking to rotate in the reverse rotational direction β about a center axial line A3 relative to the third gear 74 is generated on the return spring 76 after the third gear 74 reaches the operating position P3 (see FIG. 7), and this biasing force from the torsion moment T1 of the return spring 76*d* enables the third gear 74 to be restored from the operating position P4 (see FIG. 12) through operating position P5 (see FIG. 13) to the initial position P1 (see FIG. 5).

At the same time, after the third gear 74 reaches operating position P3 (see FIG. 7), the second gear 72 is able to rotate in the forward rotational direction α about the center axial line, following the rotation of the large gear 74*a* on the third gear 74 to return from the operating position P4 (see FIG. 12) through the operating position P5 (see FIG. 13) to the initial position P1 (see FIG. 5).

Also, at the same time the first gear 70 is able to follow the rotation of the second gear 72 and rotate in the reverse rotational direction β about the center axial line A1 to be restored from the operating position P4 (see FIG. 12) through the operating position P5 (see FIG. 13) to the initial position P1 (see FIG. 5).

At the same time, moreover, after the first gear 70 reaches the operating position P3 (see FIG. 7), the rotary member 58 and rotary shaft 46, by rotating in the reverse rotational direction β about the center axial line A1 as one piece with the first gear 70, move from the operating position P4 (see FIG. 12) to the operating position P5 (FIG. 13).

Thereafter the rotary member 58 locking projecting portion 58*a*, under the biasing force transmitted from the return spring 76 through the third gear 74, second gear 72, and first gear 70, passes from operating position P5 (see FIG. 13)

over the locking projection 64 on the rotary windup member 60 side, and the operating handle 44, rotary shaft 46, and rotary member 58 is each able to return to the initial position P1 (see FIG. 5).

Note that in the operating device 1 according the present embodiment, a form is explained, in which, as shown in FIGS. 3 through 7 and FIGS. 12 through 14, a single return spring 76 is disposed on the second gear 72, but the return spring 76 may also be disposed on other gears 70 or 72 other than the third gear 74, and may be disposed on each gear 70, 72, and 74, so long as the rotary member 58 is able to return to the initial position (operating position P1). I.e., the return spring 76 may be disposed on at least one of the multiple gears 70, 72, and 74.

Also, in the present embodiment, a form is explained, in which the return spring 76 formed of a helical coil spring can be adopted as a biasing device for restoring to initial position, but spring elements other than the helical coil spring may also be used.

Next, referring to FIGS. 1 through 4, the operation (action) of the operating device for a flush water tank device according to an embodiment of the invention is explained.

First, with respect to the operating handle 44 in the standby state operating position P1 shown in FIGS. 2 and 5, when a toilet flush is started, a user grips the downward-extending gripping portion 44*a*, raising it through operating position P2 (see FIG. 6) on the front side as seen from the front in FIG. 2 and up to the operating position P3 (see FIG. 7), rotating the operating handle 44 in the forward rotational direction α, so that the rotary shaft 46 and the rotary member 58 rotate as one piece with the operating handle 44 about the center axial line A1 up to the operating position P3.

Also, as shown in FIGS. 5 and 6, during the period until the operating handle 44 reaches operating position P3 from operating position P1, contact by the front end portion in the forward rotational direction α of the rotary member 58 locking projecting portion 58*a* with the back end portion in the forward rotational direction α of the locking projection 64 results in the rotary member 58 being locked with the rotary windup member 60, therefore the rotary windup member 60 also rotates as one piece with the operating handle 44, rotary shaft 46, and rotary member 58 about the center axial line A1.

Thus, as shown in FIG. 7, the operating wire 38 is wound by a maximum winding amount L1 by the rotary windup member 60 and, as shown in FIG. 2, the discharge valve main body 36 valve body 42 rises from the closed valve position H1 to the highest open valve position (fully open position) H3. Then, as shown in FIGS. 1 and 2, flush water in the storage tank 14 is discharged from the discharge port 18*a* through the discharge path 18 to the conduit 16 on the toilet main body 6 and flush water is supplied into the bowl portion 8 from a spout port 12 or the like on the toilet main body 6 to perform a toilet flush.

At the same time, because the locking projection 64 engages the lock release projecting portion 50*b* in the casing 50 and the lock between the rotary member 58 and the rotary windup member 60 is released, the rotary windup member 60 rotates in the reverse rotational direction β opposite the forward rotational direction α and moves to operating position P4 (see FIG. 12).

The discharge valve main body 36 valve body 42 then drops down to valve closed position H1 with the fall in the flush water level inside the storage tank 14, and the water level inside the storage tank 14 goes to the stopped water level (or dead water level) DWL.

Also, at the point when the user releases his/her hand from the operating handle 44 gripping portion 44*a*, the operating handle 44, rotary shaft 46, and rotary member 58 also return to the standby state operating position P1.

Here, when the operating handle 44, rotary shaft 46 and rotary member 58 each reaches the operating position P3 (see FIG. 7), the return spring 76 biases the third gear 74 so that they are returned from operating position P4 (see FIG. 12) through operating position P5 (see FIG. 13), then to initial position P1 at which the toilet flushing operation can be started.

The third gear 74 at operating position P3 (see FIG. 7) thus rotates in the reverse rotational direction β about the center axial line A3, returning from operating position P4 (see FIG. 12) through operating position P5 (see FIG. 13) to initial position P1 (see FIG. 5).

At the same time, the second gear 72 at operating position P3 (see FIG. 7) rotates in the forward rotational direction α about the center axial line, following the rotation of the third gear 74 large gear 74*a* to return from the operating position P4 (see FIG. 12) through the operating position P5 (see FIG. 13) to the initial position P1 (see FIG. 5).

At the same time, the first gear 70 at operating position P3 (see FIG. 7) follows the rotation of the second gear 72 and rotates in the reverse rotational direction β about the center axial line A1 to be restored from the operating position P4 (see FIG. 12) through the operating position P5 (see FIG. 13) to the initial position P1 (see FIG. 5).

At the same time, moreover, the rotary member 58 and rotary shaft 46 at operating position P3 (see FIG. 7), by rotating in the reverse rotational direction β about the center axial line A1 as one piece with the first gear 70, move from the operating position P4 (see FIG. 12) to the operating position P5 (FIG. 13).

Thereafter the rotary member 58 locking projecting portion 58*a*, under the biasing force transmitted from the return spring 76 through the third gear 74, second gear 72, and first gear 70, and the weight of the operating handle 44 itself, passes from operating position P5 (see FIG. 13) over the locking projection 64 on the rotary windup member 60 side, and the operating handle 44, rotary shaft 46, and rotary member 58 each return to the initial position P1 (see FIG. 5), so that the next toilet flush operation may be started.

Using the operating device 1 for the flush water tank device according to the above-described embodiment of the invention, when supplying flush water to the toilet main body 6 by an operation opening the discharge valve main body 36 valve body 42 on the flush water tank device 2 supplying flush water to the toilet, rotating the operating handle 44 from operating position P1 corresponding to the closed valve position of the discharge valve main body 36 valve body 42 to the operating position P3 corresponding to the fully open position of the discharge valve main body 36 valve body 42 results in the operating handle 44 and the rotary shaft 46 rotating in the valve opening direction (forward rotational direction α) to the discharge valve main body 36 valve body 42, and together with this rotary shaft 46 the drive unit 40 rotary member 58 rotates as one piece from the operating position P1 (see FIG. 5) to the operating position P3 (see FIG. 7).

At this point, because the rotary windup member 60 is locked to the rotary member 58 by the locking projection 64 and the thin plate spring 66, the rotary windup member 60 also rotates together with the rotary member 58 (see FIG. 7) in a predetermined valve opening direction (forward rotational direction α) from operating position P1 until reaching operating position P3 (see FIG. 7). Therefore, since the operating wire 38 linking the discharge valve main body 36 and the drive unit 40 rotary windup member 60 is wound onto the rotary windup member 60, the discharge valve main body 36 valve body 42 moves from a closed valve position to an open valve position, and flush water is supplied from the storage tank 14 to the toilet main body 6.

The rotary member 58 and the rotary windup member 60 then each rotates in a predetermined valve opening direction (forward rotational direction α) from operating position P1 (see FIG. 5) to reach operating position P3 (see FIG. 7), and a predetermined amount L1 of the operating wire 38 linking the discharge valve main body 36, the drive unit 40, and the rotary windup member 60 is wound by the rotary windup member 60. Thus at the same time as the valve body 42 moves by a predetermined amount L1 of this wound operating wire 38 from valve closed position H1 (see FIG. 2) to fully open position H3 (see FIG. 2), the casing 50 lock release projecting portion 50*b* and locking projection 64 release the lock between the rotary member 58 and the rotary windup member 60. Furthermore, the rotary windup member 60 rotates in a predetermined valve closing direction (reverse rotational direction (3) opposite the predetermined valve opening direction (forward rotational direction α), regardless of any operation of the operating handle 44.

I.e., when a toilet flush operation (a valve opening operation on the discharge valve main body 36 valve body 42) is started and the discharge valve main body 36 valve body 42 temporarily moves to fully open position H3 (see FIG. 2), at least the casing 50 and the operating wire 38 quickly move to operating position P1 so that the discharge valve main body 36 valve body 42 can be closed, regardless of any operation of the operating handle 44. Therefore the toilet can be flushed while controlling the amount of flush water supplied from the storage tank 14 to the toilet main body 6 to a specified amount, for each toilet flush.

By releasing the lock between the rotary member 58 and the rotary windup member 60 using the casing 50 lock release projecting portion 50*b* and locking projection 64, the time from the start of a toilet flush operation (the discharge valve main body 36 valve body 42 valve opening operation) until valve closing (the discharge valve main body 36 valve body 42 valve opening time) can be shortened, and the specified amount of flush water required for a toilet flush can be set to a relatively small amount. Conservation of toilet flush water can therefore be achieved.

In addition, it is also the case that when, together with the rotary windup member 60 the rotary member 58 restores to the operating position P3 (see FIG. 7), the rotary member 58, rotary shaft 46, and operating handle 44 can be securely restored to the initial position P1 at which the next toilet flush operation (the discharge valve main body 36 valve body 42 valve opening operation) can be started by using the biasing force of the return spring 76, which is the initial position restoration biasing device for biasing to restore the flush toilet operation to the initial position P1 (see FIG. 5), and by the weight of the operating handle 44 itself.

As a result of the above, the operating handle 44, rotary shaft 46, and rotary member 58, in preparation for the next toilet flush operation (the discharge valve main body 36 valve body 42 valve opening operation) upon each completion of a sequence of toilet flush operations, can each be quickly and securely restored to the initial position P1 at which the toilet flush operation (the discharge valve main body 36 valve body 42 valve opening operation) can be started.

Also, using an operating device 1 for the flush water tank device according to an embodiment of the invention, the drive unit 40 comprises a first gear 70, being a drive-side rotary portion affixed to the rotary shaft 46, and a second gear 72 and third gear 74, which are slave-side rotary portions capable of following this first gear 70 drive, while the return spring 76 for restoring to the initial position is disposed on the third gear 74. Thus when the rotary member 58 and the first gear 70 reach the operating position P3 (see FIG. 7) together with the rotary windup member 60, the first gear 70, second gear 72, and third gear 74 can each be securely restored to the initial position P1 (see FIG. 5) at which the next toilet flush operation (the discharge valve main body 36 valve body 42 valve opening operation) can be started.

As a result of the above, the operating handle 44 for toilet flush operation, the rotary shaft 46, and the rotary member 58, in preparation for the next toilet flush operation (the discharge valve main body 36 valve body 42 valve opening operation) upon each completion of a sequence of toilet flush operations, can also each be quickly and securely restored to the initial position P1 (see FIG. 5) at which the toilet flush operation (the discharge valve main body 36 valve body 42 valve opening operation) can be started.

Furthermore, in the operating device 1 according an embodiment of the invention the drive-side rotary portion comprises a first gear 70 affixed to the rotary shaft 46 through the rotary member 58. Also, the slave-side rotary portion comprises a second gear 72, being a first slave-side rotary member capable of engaging the first gear 70, and a third gear 74, being a second slave-side rotary member capable of engaging the second gear 72. In addition, the return spring 76 for restoring to the initial position is mounted on the third gear 74. Thus when the first gear 70, being a drive-side rotary member, reaches the operating position P3 (see FIG. 7) together with the rotary windup member 60, the third gear 74 can be securely restored to the initial position P1 (see FIG. 5) at which the next toilet flush operation (the discharge valve main body 36 valve body 42 valve opening operation) can be started.

At the same time, the second gear 72 which engages the third gear 74 and the first gear 70 which engages the second gear 72 can also be securely restored to the initial position P1 (see FIG. 5) at which the next toilet flush operation (the discharge valve main body 36 valve body 42 valve opening operation) can be started.

As a result of the above, the operating handle 44 for toilet flush operation, the rotary shaft 46, the rotary member 58, the first gear 70, the second gear 72, and the third gear 74, in preparation for the next toilet flush operation (the discharge valve main body 36 valve body 42 valve opening operation) upon each completion of a sequence of toilet flush operations, can each be quickly and securely restored to the initial position P1 (see FIG. 5) at which the toilet flush operation (the discharge valve main body 36 valve body 42 valve opening operation) can be started.

Moreover, using the first gear 70, the second gear 72 capable of engaging this first gear 70, and the third gear 74 capable of engaging this second gear 72, each of the gears 70, 72, and 74 can be disposed in a mutually offset position within the same plane. Therefore compared to a structure in which each gear 70, 72, 74 is disposed along the axial direction of the rotary shaft 46 in the casing 50 of the drive unit 40, space along the axial direction of the rotary shaft 46 in the casing 50 of the drive unit 40 can be reduced, and interference with related internal equipment, etc. such as the water supply device 20 or the discharge valve device 22 inside the storage tank 14 disposed in the axial direction of the drive unit 40 rotary shaft 46 can be prevented.

Note that in the operating device 1 according to the above-described embodiment of the invention, a form is explained, in which, as the locking device for locking the rotary windup member 60 and the rotary member 58, a locking projection 64 and a thin plate spring 66 are respectively disposed on the rotary windup member 60 to lock the locking projection 64 and the rotary member 58 locking projecting portion 58*a*. However, it is also possible to dispose a locking projecting portion on the rotary windup member 60, or to dispose a locking projection and biasing member on the rotary member 58. It is also sufficient for the locking device to be disposed on at least either the rotary member or the rotary windup member.

Also, for the operating device 1 of the above-described embodiment of the invention, a form is explained, in which a lock release projecting portion 50*b* is disposed on a portion of the drive unit 40 casing 50 as the lock release device for releasing the lock between the rotary windup member 60 and the rotary member 58. However, the invention is not limited to such embodiment, and a separate lock release device may also be mounted at a location other than the casing 50, or a separate lock release device may be mounted on the rotary member 58 or the rotary windup member 60 itself, etc.

Furthermore, for the operating device 1 according to the above-described embodiment of the invention, a form is explained, in which the operating handle 44 is disposed on the left side portion of the storage tank 14 of the flush water tank device 2 as seen from the front side of the toilet. However, the invention is not limited to such embodiments, and may also be of a form in which the operating handle 44 is disposed on the right side portion of the storage tank 14 of the flush water tank device 2 as seen from the front of the toilet.

Also, for the operating device 1 according to the above-described embodiment of the invention, the case is explained, in which the operating handle 44 is applied to a "pull-type operating handle," in which the operating handle is pulled upward when starting a toilet flush operation. However, with respect to the multiple gears 70, 72, 74, etc. pertaining to the drive unit 40, the invention may, by appropriately changing the gears to other specifications, or adding or subtracting gears, also be applied to a "push-type operating handle" in which the operating handle is pushed and rotated when starting a flush toilet operation.

For example, parts other than the first gear 70 in the drive unit 40 of an operating device 1 (a pull-type operating handle 44 operating device 1) according to the above-described embodiment may be also be used in common with parts for the operating device drive unit in a push-type operating handle form. By so doing, the operating handle operating method (push-type or pull-type) can be easily changed as appropriate simply by changing the first gear 70 to a gear part of a different specification, or by adding additional gear parts when switching from a pull-type operating handle 44 operating device 1 to a push-type operating handle operating device.

Although the present invention has been explained with reference to specific, preferred embodiments, one of ordinary skill in the art will recognize that modifications and improvements can be made while remaining within the scope and spirit of the present invention. The scope of the present invention is determined solely by appended claims.

What is claimed is:

1. An operating device configured to operate a discharge valve disposed in a flush water tank storing flush water to be supplied to a toilet, the operating device comprising:

a rotary shaft;

an operating portion configured to rotate the rotary shaft, the operating portion being attached to an outside end of the rotary shaft;

a linking member including a first end and a second end, the first end being linked to the discharge valve; and a drive unit attached to an inside end of the rotary shaft so as to be linked to the second end of the linking member, the drive unit being configured to drive the discharge valve by a rotary operation of the operating portion so as to move the linking member from a first operating position to a second operating position, the first operating position corresponding to a closed position of the discharge valve, and the second operating position corresponding to a fully open position of the discharge valve;

wherein the drive unit includes:

a rotary portion which includes a rotary member, a drive-side gear and one or more slave-side rotary gears, the rotary member being fixed to the rotary shaft, the rotary member including a locking projection portion configured to rotate with the rotary shaft, the drive-side gear being fixed to the rotary member, the one or more slave-side rotary gears being configured to engage the drive-side gear;

a rotary windup member to which the second end of the linking member is linked, the rotary windup member being configured to engage the locking projection portion of the rotary member so as to rotate together with the rotary member from the first operating position to the second operating position when the rotary shaft and the rotary member are rotating in a direction of opening the discharge valve in order to wind up a predetermined amount of the linking member;

a locking device configured to mutually lock the locking projection portion of the rotary member and the rotary windup member until the rotary windup member rotates from the first operating position and reaches the second operating position;

a lock release device configured to release a lock among the locking device, the locking projection portion of the rotary member and the rotary windup member so as to turn the rotary windup member from the second operating position to the first operating position when the rotary member and the rotary windup member respectively rotate from the first operating position and reaches the second operating position; and an initial position restoration biasing device configured to bias the rotary member so as to restore the rotary member to the first operating position when the rotary member reaches the second operating position.

2. The operating device according to claim 1, wherein the initial position restoration biasing device is disposed on at least either the drive-side gear or the one or more slave-side rotary gears.

3. The operating device according to claim 2, wherein the one or more slave-side rotary gears includes a first slave-side rotary gear configured to engage the drive-side rotary gear, and a second slave-side rotary gear configured to engage the first slave-side rotary gear; and wherein the initial position restoration biasing device is disposed on the second slave-side rotary gear.

4. A flush water tank device configured to store flush water to be supplied to a toilet, the flush water tank device comprising:

a flush water tank configured to store flush water to be supplied to the toilet;

a discharge valve disposed in the flush water tank;

an operating device configured to operate the discharge valve, wherein the operating device includes:

a rotary shaft extending from an inside to an outside of the flush water tank;

an operating portion configured to rotate the rotary shaft, the operating portion being attached to an outside end of the rotary shaft positioned on the outside of the flush water tank;

a linking member including a first end and a second end, the first end being linked to the discharge valve; and a drive unit attached to an inside end of the rotary shaft positioned on the inside of the flush water tank so as to be linked to the second end of the linking member, the drive unit being configured to drive the discharge valve by a rotary operation of the operating portion so as to move the linking member from a first operating position to a second operating position, the first operating position corresponding to a closed position of the discharge valve, and the second operating position corresponding to a fully open position of the discharge valve;

wherein the drive unit includes:

a rotary portion which includes a rotary member, a drive-side gear and one or more slave-side rotary gears, the rotary member being fixed to the rotary shaft, the rotary member including a locking projection portion configured to rotate with the rotary shaft, the drive-side gear being fixed to the rotary member, the one or more slave-side rotary gears being configured to engage the drive-side gear;

a rotary windup member to which the second end of the linking member is linked, the rotary windup member being configured to engage the locking projection portion of the rotary member so as to rotate together with the rotary member from the first operating position to the second operating position when the rotary shaft and the rotary member are rotating in a direction of opening the discharge valve in order to wind up a predetermined amount of the linking member;

a locking device configured to mutually lock the locking projection portion of the rotary member and the rotary windup member until the rotary windup member rotates from the first operating position and reaches the second operating position;

a lock release device configured to release a lock among the locking device, the locking projection portion of the rotary member and the rotary windup member so as to turn the rotary windup member from the second operating position to the first operating position when the rotary member and the rotary windup member respectively rotate from the first operating position and reaches the second operating position; and an initial position restoration biasing device configured to bias the rotary member so as to restore the rotary member to the first operating position when the rotary member reaches the second operating position.

5. A flush toilet comprising:

a toilet main body; and a flush water tank device disposed on the toilet main body;

wherein the flush water tank device includes:

a flush water tank configured to store flush water to be supplied to the toilet main body;

a discharge valve disposed in the flush water tank;

an operating device configured to operate the discharge valve, wherein the operating device includes:

a rotary shaft extending from an inside to an outside of the flush water tank;

an operating portion configured to rotate the rotary shaft, the operating portion being attached to an outside end of the rotary shaft positioned on the outside of the flush water tank;

a linking member including a first end and a second end, the first end being linked to the discharge valve; and a drive unit attached to an inside end of the rotary shaft positioned on the inside of the flush water tank so as to be linked to the second end of the linking member, the drive unit being configured to drive the discharge valve by a rotary operation of the operating portion so as to move the linking member from a first operating position to a second operating position, the first operating position corresponding to a closed position of the discharge valve, and the second operating position corresponding to a fully open position of the discharge valve;

wherein the drive unit includes:

a rotary portion which includes a rotary member, a drive-side gear and one or more slave-side rotary gears, the rotary member being fixed to the rotary shaft, the rotary member including a locking projection portion configured to rotate with the rotary shaft, the drive-side gear being fixed to the rotary member, the one or more slave-side rotary gears being configured to engage the drive-side gear;

a rotary windup member to which the second end of the linking member is linked, the rotary windup member being configured to engage the locking projection portion of the rotary member so as to rotate together with the rotary member from the first operating position to the second operating position when the rotary shaft and the rotary member are rotating in a direction of opening the discharge valve in order to wind up a predetermined amount of the linking member;

a locking device configured to mutually lock the locking projection portion of the rotary member and the rotary windup member until the rotary windup member rotates from the first operating position and reaches the second operating position;

a lock release device configured to release a lock among the locking device, the locking projection portion of the rotary member and the rotary windup member so as to turn the rotary windup member from the second operating position to the first operating position when the rotary member and the rotary windup member respectively rotate from the first operating position and reaches the second operating position; and an initial position restoration biasing device configured to bias the rotary member so as to restore the rotary member to the first operating position when the rotary member reaches the second operating position.

* * * * *